United States Patent [19]

Nelson

[11] Patent Number: 4,522,012

[45] Date of Patent: Jun. 11, 1985

[54] BAG INSERTER MACHINE

[75] Inventor: Rodney C. Nelson, Braham, Minn.

[73] Assignee: Bemis Company, Inc., Minneapolis, Minn.

[21] Appl. No.: 415,791

[22] Filed: Sep. 7, 1982

Related U.S. Application Data

[63] Continuation-in-part of Ser. No. 311,525, Oct. 15, 1981, abandoned.

[51] Int. Cl.[3] ..... B31B 7/02

[52] U.S. Cl. ..... 53/175; 53/386; 493/100; 493/907

[58] Field of Search ..... 493/100, 101, 907; 53/175, 386, 384

[56] References Cited

U.S. PATENT DOCUMENTS

| | | | |
|---|---|---|---|
| 3,579,948 | 5/1971 | Lerner | 53/386 X |
| 3,939,624 | 2/1976 | Gidewall et al. | 53/386 X |
| 4,079,663 | 3/1978 | Heller | 493/100 |
| 4,083,293 | 4/1978 | Goldstein | 493/100 X |
| 4,142,453 | 3/1979 | Gidewall et al. | 53/175 X |

*Primary Examiner*—James F. Coan
*Attorney, Agent, or Firm*—Clayton R. Johnson

[57] ABSTRACT

A bag inserter machine having pinch rolls for automatically unwinding a perforated bag roll one bag length, bag opening and separating assemblies to cooperatively grippingly engage the leading bag of the bag roll and separating it therefrom along perforations and then opening the bag, an inserter assembly movable into the opened bag for moving the opened bag into a case on a conveyer and cuff the upper portion of the bag over the upwardly extending case top flaps, and controls to stop a case on a conveyer in a position to have a bag inserted therein, stop the drive to the pinch rolls after unwinding the bag roll a bag length, then the bag opening and separating assemblies to grippingly engage the bag to separate it from the bag roll, then open the bag, thereafter operate the inserter assembly to insert and cuff the bag and retract the inserter assembly and then allow the conveyer to move another case to have a bag inserted therein, and automatically continue the cycle of operation.

In a second embodiment, in place of an inserter assembly, a hopper assembly may be provided to drop a weighed charged of product into the opened bag and then the bag opening and separating assemblies operated to release the opened bag to fall into a case on the conveyer or the weight of product in the bag, strip the bag from the last mentioned assemblies.

In the third embodiment, the bag separating assembly is moved transversely relative the bag opening assembly as said assemblies move longitudinally together with a bag clamped therebetween to facilitate unblocking of the bag so that it will open as the opening assembly moves away from the separating assembly.

42 Claims, 24 Drawing Figures

2
2
17
17
101
100
24
24b
-25-
W
17
13
15
28
85
110
104
70
68
69
64
41
45
93d
500
112
91
93c
92
C
400
121
237
121
11
119
182
180
10
93
145
146
153
154
93b
147
152
155
90
148
149
156
14
143
140
12
93a
142
16
141
125c
121
501
120
500
125d
500d
119a
160c

BAG INSERTER MACHINE

CROSS REFERENCE TO RELATED APPLICATIONS

This application is a continuation-in-part of my application Ser. No. 311,525, filed Oct. 15, 1981, now abandoned.

BACKGROUND OF THE INVENTION

A machine for inserting a plastic bag into an open case.

In the prior art, machines have been provided with a mandrel over which a bag is manually placed and then a button punched whereupon the mandrel moves downwardly to insert the bag thereon into a case having open top flaps and the bag top portion folded over the top flaps to form a cuff. The cases are automatically indexed into position. Further, it is old to provide a machine having air jets for cuffing an inserted bag over the open top flaps of a case.

In order to provide improvements of machines of the above nature, this invention has been made.

SUMMARY OF THE INVENTION

A bag inserter machine having feed mechanism for unwinding presealed and perforated tubular bag roll stock a bag length, a bag opening and a bag separating assembly for cooperatively grippingly engaging the roll stock at a location closely adjacent the juncture of the leading bag of the roll stock along a line of perforations to the next bag and on the side of the juncture between the line of perforations and the bottom terminal edge of the leading bag and thence moving relative the feed mechanism to separate the leading bag from the roll stock along said line perforations, said bag opening and separating assemblies having vacuum devices to grippingly engaging opposite side walls of the leading bag to open the bag when the bag opening assembly is moved away from the bag separating assembly and an insert assembly for moving the opened bag into an open case.

One of the objects of this invention is to provide new and novel means for grippingly engaging the leading bag that is joined along a line of perforations to another bag on tubular roll stock and moving the leading bag relative the remainder of the roll stock along said line of perforations. Another object of this invention is to provide new and novel means for separating the leading bag of bag roll stock that is joined to the next bag in end-to-end relationship along a line of perforations and thence opening the separated bag and holding the opened bag in position to have a bag insert assembly moved thereinto or have product dumped into the bag prior to the bag being moved and moving into a case located below the bag mount of the held opened bag.

Still another object of the invention is to provide new and novel plunger assembly for inserting a plastic bag into a case. In furtherance of the last mentioned object, it is an object of this invention to provide new and novel means for cuffing the bag top portion over the vertical top flaps of the case into which the bag is inserted.

An additional object of this invention is to provide new and novel means on a conveyer assembly for controlling the positions of the cases on a moving conveyer belt, including retaining one case at a time in a position below a bag having an open bag mouth directly below a hopper spout assembly or an inserter assembly for inserting the empty bag into the case.

A further object of this invention is to provide on a machine for separating a bag from a bag roll new and novel means for unblocking the bag mouth side wall edge portions prior to mechanically opening the bag mouth. A still further object of this invention is to provide new and novel bag separating and opening assemblies to clampingly engage the upper edge portions of opposite plastic bag side walls of an unopened bag and while clampingly engaging the bag, move the unopened bag longitudinally in a direction generally perpendicular to the planes of the side walls and at the same time, also move one of the assemblies transversely relative the other to unblock said edge portions prior to opening the bag.

BRIEF DESCRIPTION OF THE DRAWINGS

FIG. 16 is a simplified schematic illustration of the pneumatic circuitry and components of the first embodiment;

Figures 1, 1B:
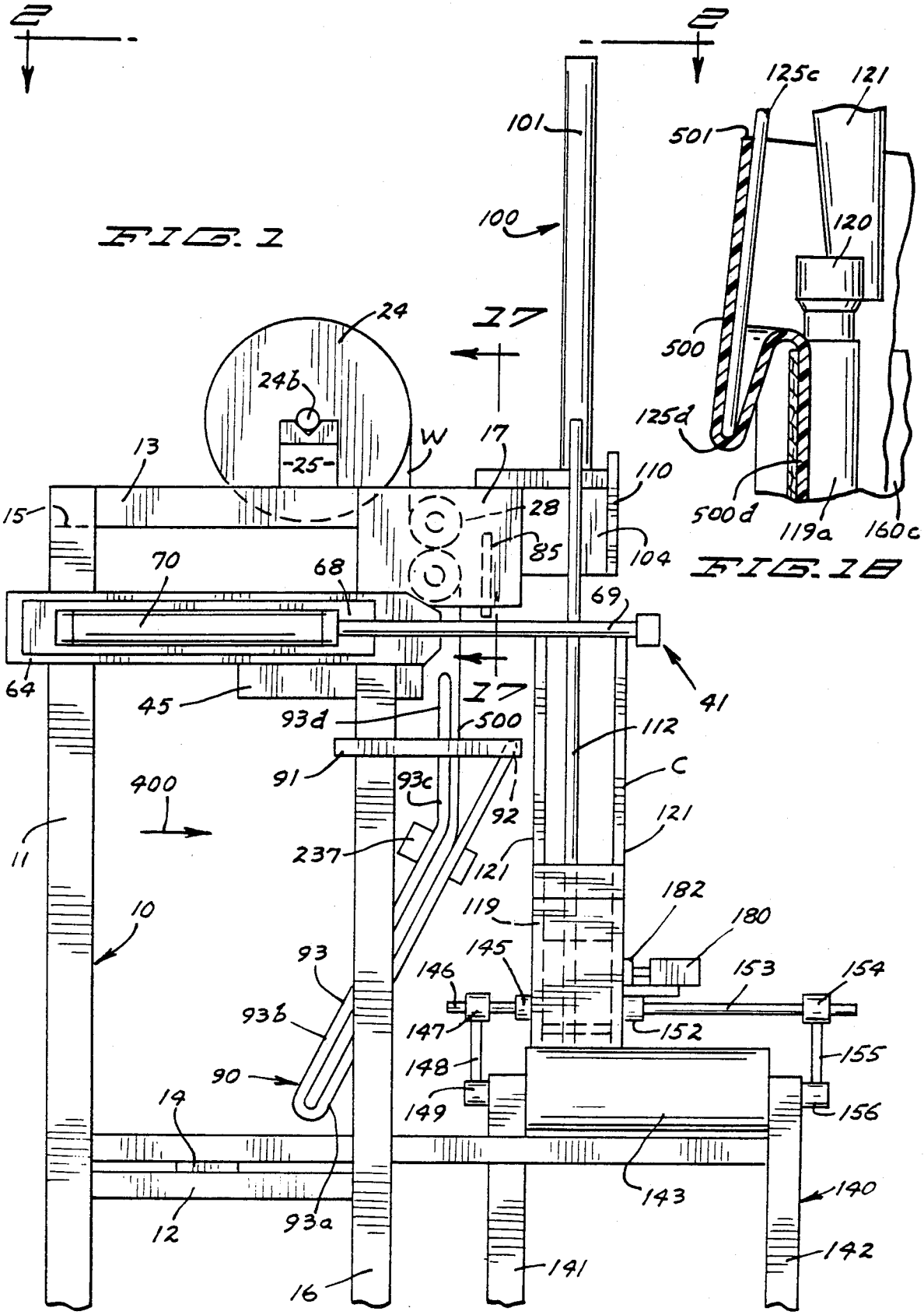
FIG. 1 is a somewhat diagrammatic side view of the bag inserter machine of the first embodiment of invention with many parts not shown and of the conveyer assembly used in association therewith, the bag insert assembly being shown in a lowered position with the bag extended into a case on the conveyer belt but to the upper edge portion of the bag being cuffed over the top portion of the case.
Figure 2:
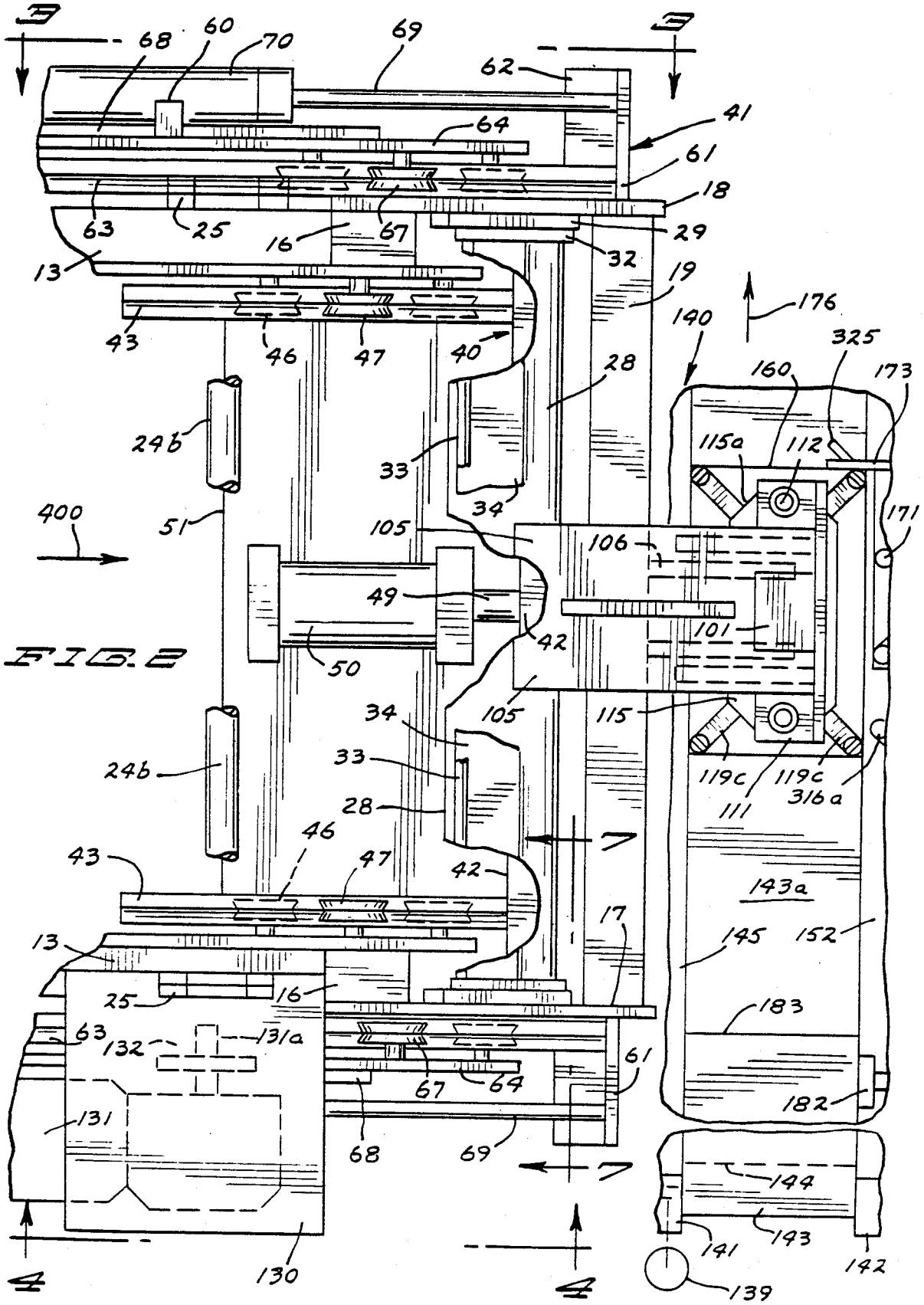
FIG. 2 is a fragmentary plan view of the apparatus of FIG. 1 with various portions broken away, said view being generally taken along the line and in the direction of arrows 2—2 of FIG. 1 other than the bag opening assembly is shown abutting against the bag separating assembly and the bag insert assembly is retracted.

Referring now in particular to FIGS. 1 and 2, the bag insert machine includes a frame, generally designated 10, which has a pair of front uprights 16, a pair of rear uprights 11, lower longitudinal channels 12 extending between and joined to the uprights 11 and 16 on the respective transverse side of the machine, upper longtudinal channels 13 joined to and extending between the uprights 11, 16 on the respective side of the machine, transverse channels 15 extending between uprights 11 and a mounting plate 14 that is joined at its opposite ends to the channels 12. Further, the frame includes vertical mounting plates 17 and 18 that are mounted by the upper end of the adjacent channel 16 to extend forwardly thereof, and a transverse channel 19 that is secured to the upper front corner portions of the mounting plates 17 and 18.

Figure 6:
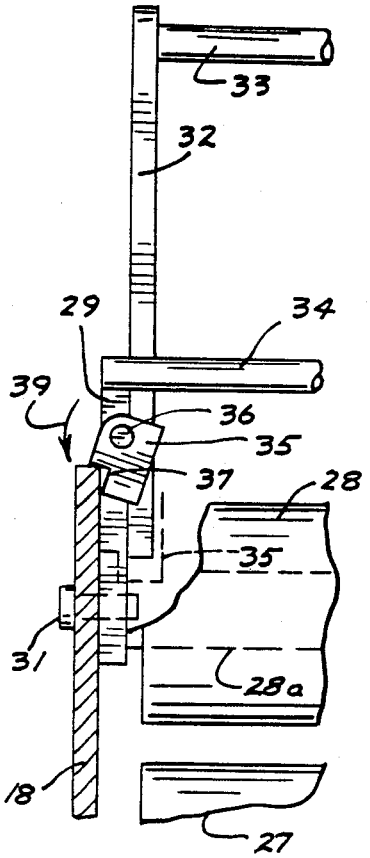
FIG. 6 is a fragmentary transverse cross sectional view generally taken along the line and in the direction of the arrows 6—6 of FIG. 3 other than it shows the upper pinch roll being held in spaced relationship to the lower pinch roll.

Referring to FIGS. 1-3 and 7, a pair of reel mounts 25 are respectively mounted by a mounting plate 130 and one of the channels 13 and have upwardly opening V-shaped notches for receivingly supporting the opposite ends of a reel shaft 24*b* of the reel 24. The reel includes reel flanges 24*a*. The reel is provided for mounting a bag roll of perforated plastic, for example polyethelene, lower and upper pinch rolls 27 and 28 respectively being located to receive the bag roll web from the reel. The lower roll 27 includes a shaft 27*a* that is rotatably mounted by frame plates 17 and 18 while the upper roll includes a roll shaft 28*a*. The upper roll shaft 28*a* is rotatably mounted by plates 29 which in turn are pivotally mounted on the adjacent one of plates 17 and 18 by a pivot 31 (also see FIG. 6). The outer end portions of shaft 28*a* extend through openings 30 provided in the respective plates 17 and 18 to permit the upper pinch roll being moved from the position shown in FIG. 3 to a more elevated position as is shown in FIG. 6. In order to facilitate moving the upper pinch roll, bars 32 have their one ends joined to plates 29 while a handle rod 33 is mounted by the upper ends of the bars 32. A transverse brace 34 has its opposite ends mounted by the plates 29.

In order to releasably retain the upper roll in spaced relationship to the lower roll, a latch 35 is pivotally mounted on one of the plates 29 by a pivot member 36 (FIG. 6). The latch has a downwardly opening notch 37 and has a center of gravity such that the latch will pivot to have the notched portion of the latch abut against the upper edge of plate 18 as shown in FIG. 6 to hold the upper pinch roll in its elevated position but can be manually pivoted in the direction of arrow 39 to a position for lowering the upper pinch roll whereby the latch extends in abutting relationship with the vertical surface of plate 18 such as shown in dotted lines in FIG. 6.

In order to separate a bag from the bag roll and open the bag there are provided a pair of vacuum cup assemblies, namely a bag separating assembly generally designated 40 and a bag opening assembly generally designated 41. Referring in particular to FIGS. 2, 3, 5, 8 and 9, the bag separating assembly includes a transverse angle iron 42 that at its opposite end is mounted by a pair of longitudinally extending guide rails 43. As may be noted in FIG. 7, the guide rails are of rectangular shape in transverse cross section and one corner portion directly above the diagonally opposite corner portion. To mount the guide rails 43 for movement in a forward and a rearward direction, there is provided an upper grooved roller 47 and a pair of longitudinally spaced lower grooved rollers 46. As may be noted from FIGS. 4 and 7, the upper roller is mounted above and longitudinally intermediate the lower rollers with the respective vertically spaced apex corner portions of the rail extending into the groove of the adjacent roller. The rollers 46, 47 are rotatably mounted by a plate 45 which in turn is mounted by the adjacent upright 16.

To move the angle iron (vacuum cup mounting member) 42 between its datum retracted position and its extended bag separating position, the piston rod 49 of the bag separating piston cylinder combination 49, 50 is connected to a transverse intermediate part of the angle iron 42. The cylinder 50 is mounted on a transverse plate 51 that at its opposite ends is secured to the adjacent plate 45.

For the particular model of the machine of the first embodiment that is described herein, the bag separating assembly includes four vacuum cups 54, two on either transverse side of the piston rod 49. Each of the cups 54 is mounted by a bar 53, the respective bar 53 being secured to the mounting member in a transverse adjusted position by nuts and bolts 44 with the bolts being extended through the respective transversely elongated slot 52 provided in the mounting member (see FIG. 9). There is a transverse slot on each side of the piston rod. An angle iron 55 is mounted on the transverse center part of angle iron 42 to have a vertical leg 55*a* extend thereabove the forward surface thereof located in approximately the same vertical transverse plane as the front edges of the vacuum cups 54 to aid in guiding the bag as will be described hereinafter.

The bag opening assembly 41 includes a transversely elongated angle iron (vacuum cup mounting member) 62 that is of a greater transverse length than the mounting member 42, a tab 61 being mounted on each end of the angle iron 62 to extend thereabove. To support the mounting member 62 for movement in a forward and rearward direction between a bag open position and a closed bag gripping engaging position, a rectangular shaped guide rail 63 is secured to each tab 61 to extend rearwardly thereof. Each guide rail is mounted by rollers in the same manner as the guide rails 43 are mounted, each guide rail 63 having a pair of spaced lower grooved rollers 66 abutting against the lower corner portion of the rail and an upper roller 67 abutting against the upper corner (apex) portion of the rail. The rollers 66, 67 are rotatably mounted by a plate 64, bars 65 being secured to the plate 64 and to the adjacent one of the uprights 11 and 16 for supporting the plate transversely outwardly of the uprights on the respective side of the machine.

For moving the bag opening mounting member 62 between its positions, there are provided a pair of piston cylinder combinations 69, 70, one of such combinations being on either side of the machine. Each piston rod 69 is secured to the respective tab 61 to extend rearwardly thereof, its cylinder 70 being mounted on the slide plate 68. A rack 77 is mounted on each slide plate, each slide plate being supported for forward and aft movement by brackets 60 mounted on plate 64 and a pinion 78 with the teeth thereof in meshing relationship with the teeth of the adjacent rack 77. The pinions 78 are keyed to a transverse rod 76 which in turn is rotatably mounted by plates 64, a crank 79 being keyed to the shaft 78 for rotating the pinions to move the racks and thereby plates 64 and cylinders 70 in forward or rearward direction for purposes to be described hereinafter.

The bag opening assembly includes a plurality of vacuum cups 75, there being provided one vacuum cup 75 for each cup 54 to cooperate therewith for initially gripping opposite side walls of a closed bag. For mounting the vacuum cups 75 in proper transverse adjusted relationship to the cups 54, each cup 75 is mounted by a bar 74 which in turn is mounted by a pair of nuts and bolts 80 with bolts extended through the respective slot 73 in the vertical leg of the angle iron 62. A slot 73 is provided on each of the transverse center of the angle iron. The horizontal leg of the angle iron 42 mounts a transversely elongated rubber strip 57 to extend forwardly of the front edge of said horizontal leg, a mounting member 58 being provided to removably secure the rubber strip to the angle iron. To cooperate with the rubber strip 57, the horizontal leg of the angle iron 62 mounts a rubber strip 81 to extend rearwardly thereof, there being provided mounting members 92 for removably securing the rubber strip to the angle iron 62. The rubber strips 57, 81 are located at the same elevation with the transverse rear edge of the strip 81 being located in substantially the same transverse vertical plane as the bag gripping edges of the cups 75 while the front edge of the strip 57 is located in substantially the same transverse plane as the front bag gripping edges of the cups 54. Further, as may be noted from FIG. 3, when the rubber strips are in abutting relationship in the datum position of the bag separating assembly (assuming no bag is extended therebetween), said strips are at a lower elevation than the pinch roll 27 and substantially directly beneath or slightly rearwardly of the vertical transverse plane that extends tangental to the front of the pinch roll. Further, said edges in the aforementioned abutting relationship are a short distance horizontally rearwardly of a separating plate 85 which is transversely elongated and has opposite edges mounted by bars 86, bars 86 in turn being mounted by the adjacent one of plates 17, 18. The lower edge of the separating plate is of a very shallow V-shape as it may in part be noted from FIG. 9, the apex 85*a* of the lower edge being located at a slightly higher elevation than the top edge of leg 55*a* and at a higher elevation than the vacuum cups. Further, the apex 85*a* is transversely centered and located substantially directly above piston rod 49 when said rod is extended. It is also to be noted from FIG. 3 that the separating plate is located rearwardly of the vacuum cups 54 when the bag separating assembly is in its bag separated position.

Referring now in particular to FIGS. 1, 3, 5 and 9, there is provided a bag guide (bag holder), generally designated 90, the purpose of which will be explained hereinafter. The bag guide includes a bar 91 secured to each upright 16 to extend forwardly thereof. The forward end of the bars 91 mount a transverse mounting rod 92 which in turn has the upper terminal ends of legs 93*a*, 94*a* of rods 93, 94 respectively welded thereto. Legs 93*a*, 94*a* extend parallel to one another and are inclined downwardly in a rearward direction to have the lower ends thereof reversely bent and integrally joined to the respective one of the upwardly and forwardly inclined leg 93*b* and a corresponding leg (not shown) of rod 94. Leg 93*b* and the corresponding leg of rod 94 extend parallel to one another and are spaced from the linear parts of legs 93*a*, 94*a* and terminate at a lower elevation than rod 92. The upper end of leg 93*b* and the corresponding leg of rod 94 are integrally joined to the lower ends of the respective vertical legs 93*c*, 94*c* which are located a substantial distance rearwardly of rod 92 and extend to a higher elevation than rod 92. The upper ends of legs 93*c*, 94*c* are respectively joined to the lower ends of legs 93*d*, 94*d* which diverge transversely away from one another in an upward vertical direction, and have upper terminal ends at a slightly lower elevation than the lower edge of the angle iron 42. The front surfaces of legs 93*c*, 93*d*, 94*c*, 94*d* are located in a plane that is a slight distance rearwardly of the front edge of the rubber strip 57 when the bag separating assembly is in its retracted datum position and rearwardly of a transverse vertical plane tangental to the front part of pinch roll 27 while the rear surfaces of the upper terminal end portions of legs 93*a*, 94*a* and rod 92 are located forwardly of and a substantial distance beneath the separating plate 85. Thus when the bag roll web is fed downwardly between the front portion of feed roll 27 and the separating plate, the lower edge of the advance terminal bag 500 on the roll will extend downwardly between legs 93*c*, 94*c* and legs 93*a*, 94*a* when the lower edge 502 of the bag has been fed to a sufficiently low elevation.

Figure 3:
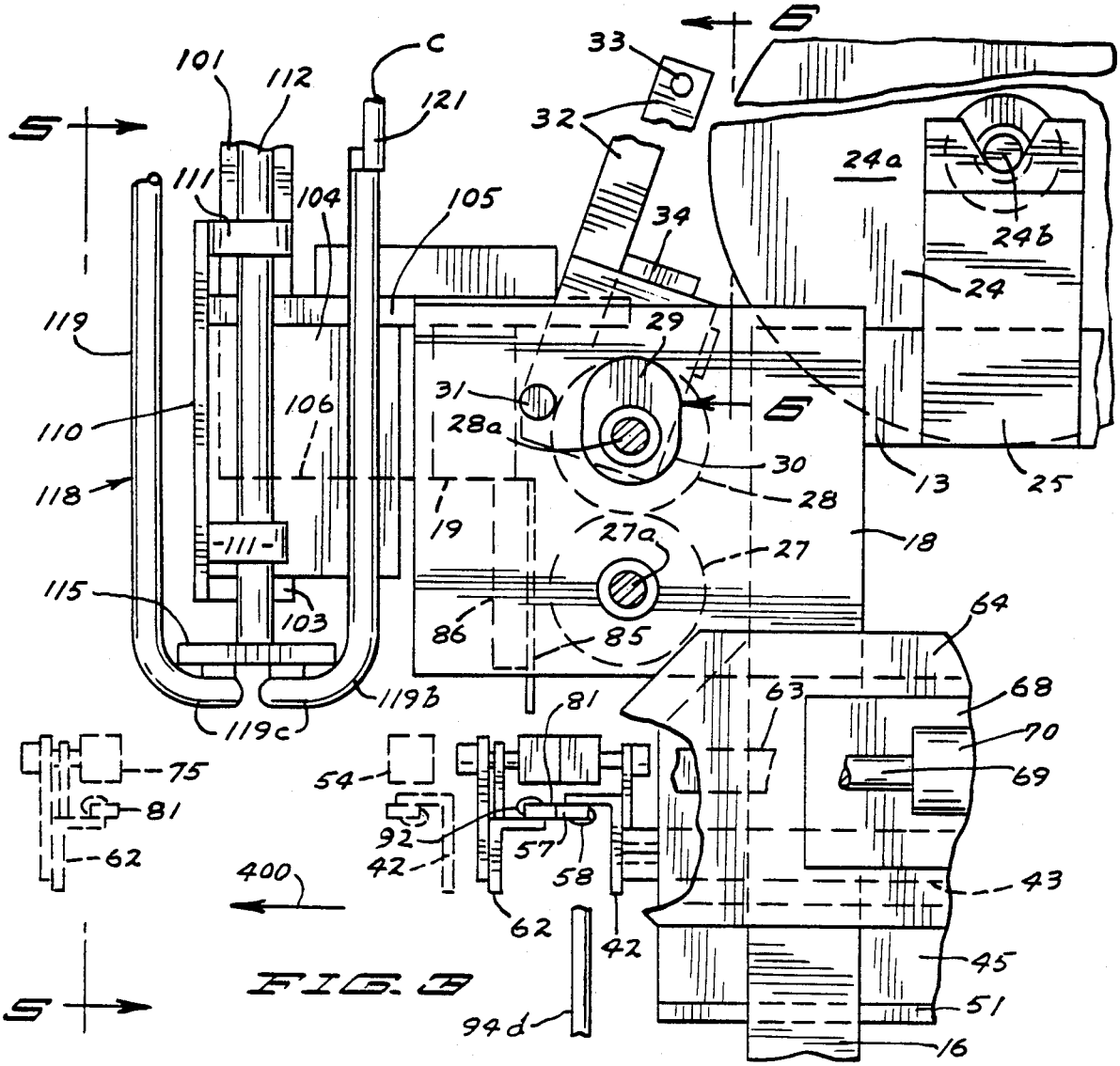
FIG. 3 is fragmentary side view generally taken along the line and in the direction of the arrows 3—3 of FIG. 2, various portions being broken away and the bag insert assembly being in a retracted position, the vacuum cup bag opening and bag separating assemblies being shown in solid lines in a bag gripping position prior to the bag being separated from a bag roll, and the vacuum cup assemblies being shown in dotted lines in a position for holding the bag open prior to and while the bag insert assembly is being inserted into the held bag.
Figure 4:
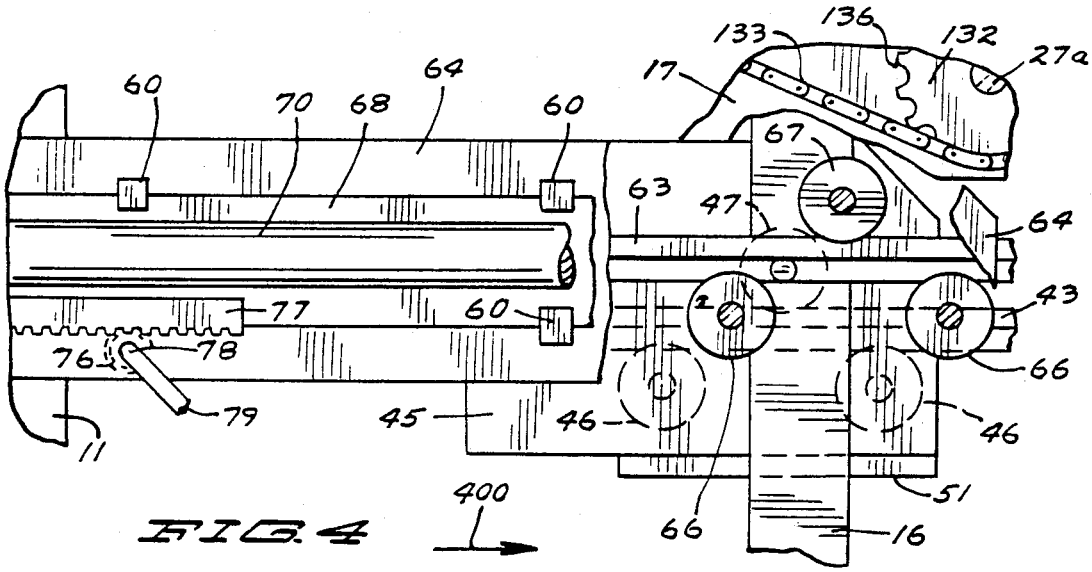
FIG. 4 is a fragmentary side view generally taken along the line and in the direction of the arrows 4—4 of FIG. 2 to illustrate the mounting of a bag opening cylinder and the guide rails of the vacuum cup assemblies, various portions of the view being broken away.
Figure 5:
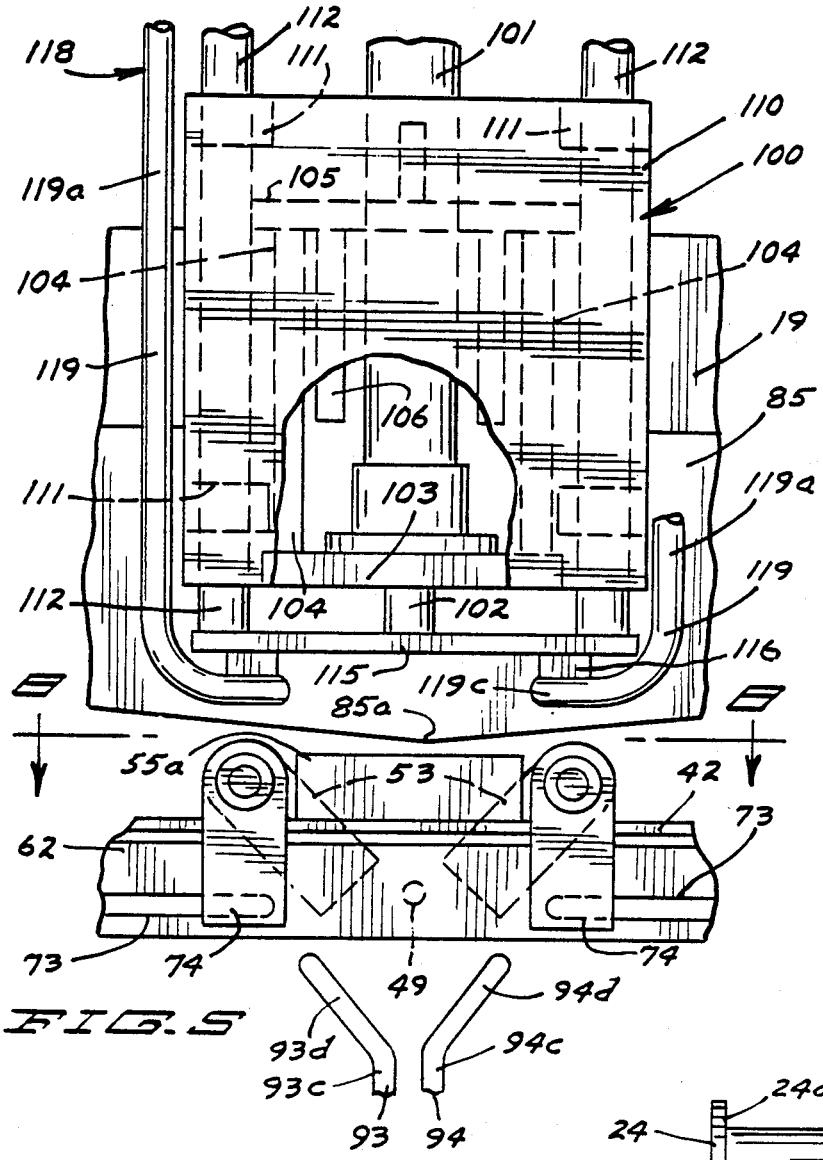
FIG. 5 is a fragmentary front view generally taken along the line and in the direction of the arrows 5—5 of FIG. 3 to illustrate parts of the bag opening assembly and the bag insert assembly.

For inserting an open bag into the case, there is provided a bag inserter assembly, generally designated 100 (see FIGS. 2, 3 and 5). The bag inserter assembly includes a piston-cylinder combination 101, 102, the cylinder being mounted by a horizontal plate 103 to extend thereabove. The plate 103 is mounted by a pair of transversely spaced vertical plates 104 to depend therefrom, the upper edges of the plates 104 being dependingly secured to a horizontal plate 105. The cylinder 101 extends up through an appropriate aperture in plate 105. The plate 105 has a rear end portion thereof mounted on horizontal frame member 19 in transverse center relationship thereto. A pair of transversely spaced plates 106 are dependingly secured to the plate 105 to the rear edges thereof to abut against frame member 19. If desired, plate 105 may be mounted on frame member 19 to be selectively adjusted in a fore and aft direction to selectively vary the longitudinal spacing of the cylinder 101 from the frame member, plates 106 limiting the rearward adjustment.

To the front edges of plate 104 there is secured a vertical plate 110, each vertical edge portions of the plate 110 mounting a pair of vertically spaced bushings 111. Each of the pair of vertically spaced bushings slidably mount a guide rod 112 for vertical movement, the lower end of each guide rod being secured to plate 115 with the cylinder being transversely centered relative the guide rods.

The piston rod 102 extends through appropriate aperture in plate 103 to have the lower end thereof secured to the center portion of the horizontal plate 115. As may be noted in FIG. 2 each corner portion of plate 115 is cut off along an edge 115*a*. Adjacent each of the four edges 115*a* of the plate 115 there is removably secured a combination of a spacer 116 and a plunger and cuffing subassembly, generally designated 118. Each plunger and cuffing subassembly includes a plunger tube 119 having a vertically elongated tubular portion 119*a* that at its lower end is joined to a curved portion 119*b* that is curved downwardly and generally inwardly toward the center of plate 115 (and center axis of piston rod 102), the opposite end of the curved portion being integrally joined to a generally horizontal portion 119*c* which is retained in spaced relationship to plate 115 and removably secured thereto through the spacer 116 by, for example nuts and bolts (not shown). The vertical height of each plunger tube is about the same as the height of the case with its top flaps extending vertically while the horizontal length of the curved portion 119*b* and horizontal portion 119*c* would depend on the shape of the case in plan view; i.e. to have one portion 119*a* located adjacent each corner of the case and in the case when the insert assembly is in its extended position within the case.

Figure 10:
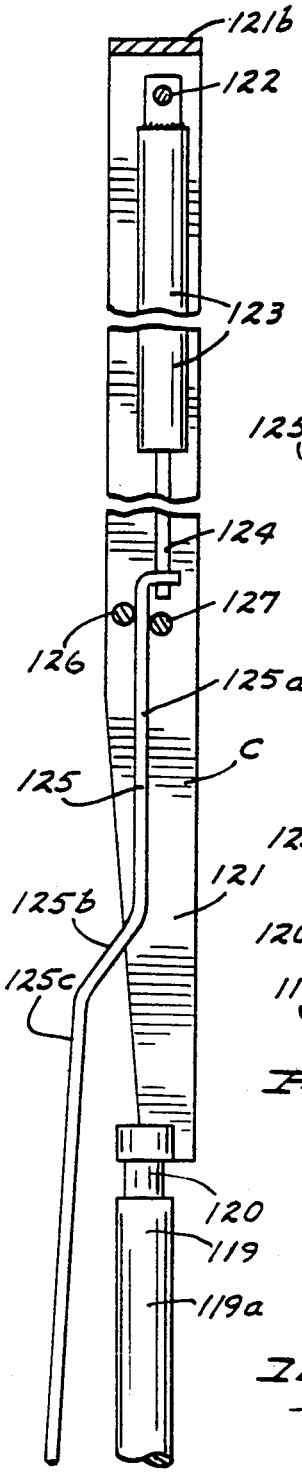
FIG. 10 is a fragmentary view of one of the cuffing assemblies in a cuffing finger extended position with vertically intermediate portions thereof being broken away, said view being generally taken along the line and in the direction of the arrows 10—10 of FIG. 13.

Each subassembly 118 also includes cuffing mechanism C (see FIGS. 10–12) that has a rod 120 threaded into the upper end of the respective plunger tube vertical portion. A U-shaped bracket 121 has the lower terminal end portions of its legs 121*a* secured to the upper end of rod 120 while the web portion 121*b* thereof is located a substantial distance vertically above rod 120. The upper end portions of the legs 121*a* mount a pivot member 122 which in turn pivotally mounts a cylinder 123 to extend in depending relationship thereto. The cuffing piston-cylinder combination 123, 124 also includes a piston rod 124 that is connected to the upper end of a cuffing finger 125.

The cuffing finger 125 vertically movably extends between a pair of rollers 126, 127 that are mounted by the bracket legs vertical intermediate pivot 124 and rod 120. The rollers are located with roller 126 at a slightly higher elevation than roller 127 and are provided to control the movement of the cuffing finger as described hereinafter. The cuffing finger in an extended cuffing position has the upper part of the vertically elongated upper portion 125*a* thereof extended between the rollers with portion 125*a* extending substantially vertical (parallel) to the central axis of the plunger piston rod 102. The lower end of portion 125*a* is integrally joined to the upper end of an intermediate portion 125*b* that diverges downwardly and outwardly relative the central axis of piston rod 102, portion 125*b* being of a much shorter length than the length of portion 125*a*. To the lower end of portion 125*b* there is integrally joined the upper end of a vertically elongated portion 125*c* that also diverges downwardly and outwardly relative the central axis of piston rod 102 but at a much smaller angle than the angle of divergence of portion 125*b*. As may be noted from FIG. 10, portion 125*c* in the finger extended position extends progressively further outwardly of the central axis of the plunger tube portion 119*a* in a downward direction and has the lower end thereof at a substantially lower elevation than the upper terminal edge of tube 119*a* while portion 125*a* is parallel to and very closely adjacent the extension of the central axis of portion 119*a*. Portion 125*a* is of a length many times greater than the length of portion 125*b*. In the cuffing finger datum retracted position of FIG. 11, the lower terminal end 126*d* of the cuffing finger is vertically above the upper terminal end of tube portion 119*a* and entirely located more closely adjacent the extension of the central axis of said portion 119*a* than the outer circumferential surface of said portion 119*a* to its central axis. Further, in the cuffing finger retracted position the intermediate portion 125*b* extends between the rollers 126, 127.

Figure 7:
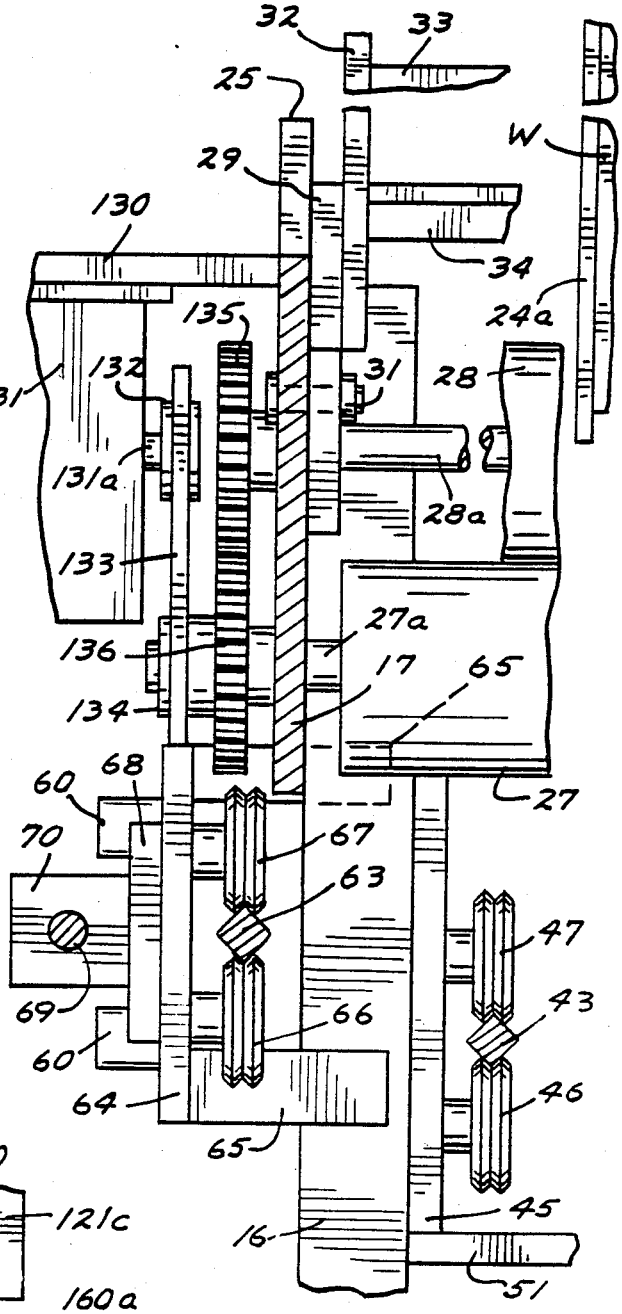
FIG. 7 is a fragmentary transverse cross sectional view generally taken along the line and in the direction of the arrows 7—7 of FIG. 2 to more clearly illustrate the mounting of the guide rails for the bag opening and separating assemblies and parts of the drive structure for the pinch rolls.

Referring in particular to FIGS. 2 and 7, the drive for the pinch rolls includes a motor-reducer combination 131 (which may be of a variable speed) that is dependingly mounted by a plate 130, the plate being mounted by one of the frame members 13 to extend outwardly thereof. The combination 131 includes an output shaft 131*a* having a spocket 132 keyed thereto. A chain 133 is extended around spocket 132 to be driven thereby and around spocket 134 to drive the last mentioned spocket. Spocket 134 is keyed to the outer end portion of the lower pinch roll shaft 27*a*. Also keyed to the lower pinch roll shaft is a gear 136 that has its teeth in intermeshing relationship with the teeth of gear 135 when the pinch rolls are in the position shown in FIG. 3. Gear 135 is keyed to the upper pinch roll shaft 28*a*.

Figure 14:
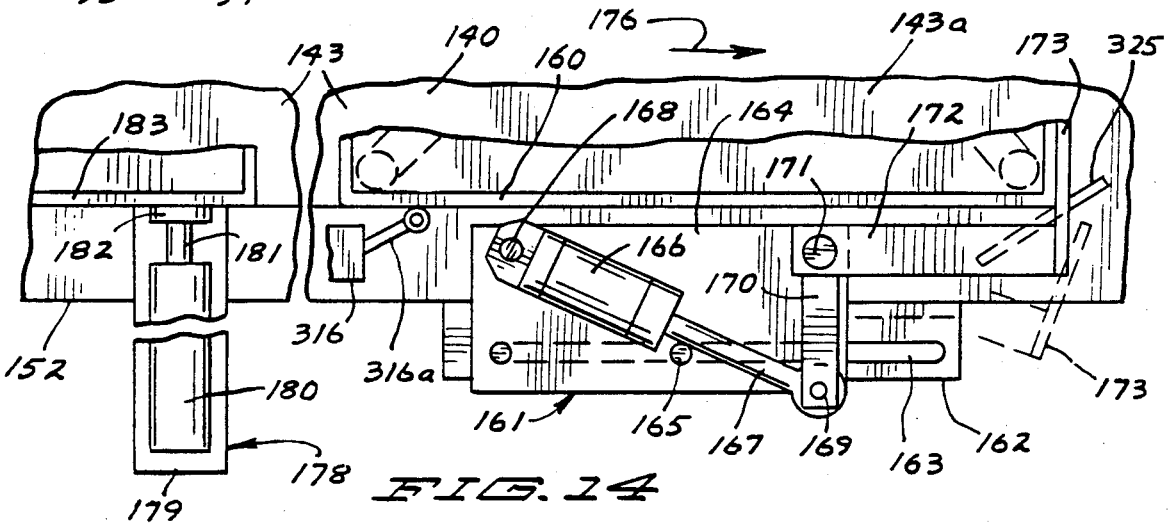
FIG. 14 is a fragmentary plan view of the conveyer assembly with transverse intermediate portions broken away to show the case clamp and case stop assemblies, the stop plate being shown in a case stop postion in solid lines and in a retracted position in dotted lines.

In order to move cases with open tops, one after another, beneath the bag inserter assembly to have plastic bags inserted thereinto, there is provided a conveyer assembly, generally designated 140 (see FIGS. 1, 2 and 14). The conveyer assembly includes a conveyer belt 143 having a generally horizontal upper run 143*a*, the conveyer belt being extended around an idler roll (not shown) and a roll 144 that is suitably connected through a drive connection to a motor 139. The driven roll 144 and a idler roll are mounted by the conveyer frame 141, 142.

To properly space the case in a forward and aft direction relative the inserter machine as the case is moved in a transverse direction relative the machine by the conveyer belt, there is provided case guide rails 145, 152. The guide rail 145 is mounted for adjustable movement in a vertical and horizontal direction by rods 146 that are rotatable mounted by the rail, the rods 146 being threadedly extended through blocks 147 while the blocks dependingly rotatably mount the threaded rods 148 that are threadably extended through blocks 149 mounted on conveyer side frame 141. Similarly guide rail 152 is mounted for adjustable horizontal and vertical movement by rods 153 rotatably mounted by the rail and being threadably extended through blocks 154 while the blocks dependingly rotatably mount threaded rods 155 which in turn are threadably extended through blocks 156 that are mounted by conveyer side frame 142.

In order to stop case 160 on the conveyer belt in a proper position to have a bag inserted thereinto, there is provided a case stop assembly, generally designated 161 (FIGS. 2 and 14). The case stop assembly includes an angle iron 162 having a vertical leg secured to guide rail 152 and a horizontal leg provided with a slot 163 elongated in the direction of elongation of rail 152. The mounting plate 164 is secured in selected adjusted position along the length of angle iron 162 by nuts and bolts 165 with the bolts being extended through slot 163. A pivot member 168 is mounted by plate 164 and pivotally mounts a cylinder 166 of a piston-cylinder combination 166, 167. The piston rod 167 is pivotally connected at 169 to one end of arm 170 while the opposite end of arm 170 is fixedly secured to one end of arm 172 that extends at right angles relative thereto. The juncture of arms 170,172 are pivotally connected to mounting plate 164 by a vertical pivot member 171. The end of arm 172 remote from pivot 171 mounts a stop plate 173. The pivots 168, 169 and 171 are located relative to one another and the length of arm 172 and stop plate 173 are such that when the piston rod 167 is in its retracted position the stop plate is in the dotted line position of FIG. 14 out of the path of movement of a case by the conveyer belt; and in the piston rod extended position the plate 173 extends over the conveyer belt into the path of movement of a case to prevent it moving further with the conveyer belt in the direction of arrow 176.

In order to retain a case 183 on the conveyer belt at least approximately a case-length away from case 160 when case 160 is in a position to have a bag inserted therein and cases that are more remote from case 160 than case 183 from moving with the conveyer belt toward case 160 until after a bag has been inserted in case 160, there is provided a case clamp assembly, generally designated 178. The case clamp assembly includes a mounting plate 179 that is secured to side rail 152 and mounts the cylinder 180 of a piston-cylinder combination 180, 181. The piston rod 181 mounts a clamp plate and pad 182 for abutting against one side wall of case 183 when the piston rod is in extended position. The clamp plate in being moved to its extended position forces the case 183 against the side rail 145 to prevent further movement of the case with the conveyer belt until the clamp plate is retracted.

Figure 15:
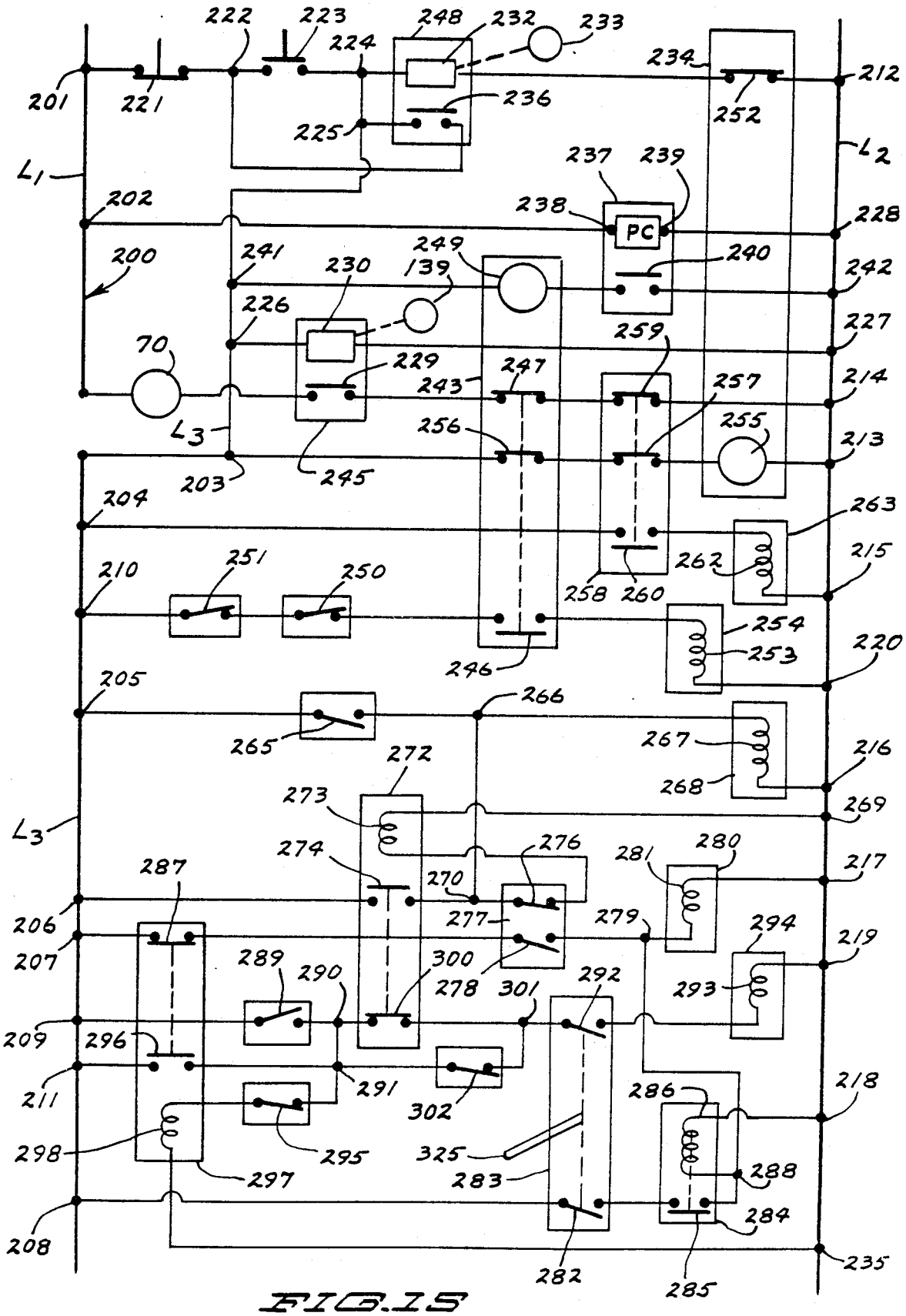
FIG. 15 is a simplified schematic illustration of the electrical circuitry and components of the first embodiment.

Referring now to FIG. 15 the electric controls and control components, generally designated 200 will now be described. The electric controls include main line $L_1$ having junctions 201 and 202 thereon, a main line $L_2$ having junctions 212–219, 227, 228, 242, 269 and 235 thereon and a line $L_3$ having junctions 203–211, 224–226 and 241 thereon.

An emergency stop switch has a switch member 221 resiliently retained in a closed position to electrically connect junctions 201, 222 while a start switch 223 that is resiliently retained in an open condition is connected across junctions 222, 224.

A conveyer motor starter relay 245 includes a switch member 229, and a solenoid coil 230 that is connected across junctions 226,227. When coil 230 is energized, switch member 229 moves to a closed position. Coil 230 through conventional electric circuitry (not shown) controls the energization of the conveyer motor 139 so that when and as long as the coil energized, electric power is provided to energize motor 139.

The coil 232 of a vacuum pump starter relay 248 and switch member 252 of a time delay relay 234 are connected in series across junctions 224,212. When and as long as coil 232 is energized, through conventional electric circuitry (not shown) the vacuum pump motor 233 is energized. Motor 233 drives the vacuum pump 234. The vacuum pump relay includes a normally open switch member 236 connected across junctions 225, 241.

A conventional sensing unit 237 has a terminal 238 connected to junction 202 and a terminal 239 connected to junction 228. Further, the sensing unit includes a normally open switch member 240 that is connected in series with coil 249 of bag feed stop relay 243 across junction 242 and junction 241. The sensing unit may be, for example a photo electric eye unit mounted on the bag guide in selected adjusted position wherein the emiter and receiver are connected between terminals 238, 239 and when the beam of light between the emiter and receiver is broken will move switch member 240 to a closed position until discontinuance of the breakage of the beam of light.

Connected in series across junctions 202, 214 are pinch roll drive motor 70, switch member 229, a normally closed switch 247 of relay 243, and a normally closed switch member 259 of separating cylinder retract relay 259. Relay 243 also includes a normally closed switch member 256, and a normally open switch member 246, switch member 246 being moved to a closed position and retain a closed position as long as the solenoid coil 249 is energized and switch members 247, 256 being retained in an open condition as long as coil 249 is energized. Connected in series across junctions 210, 220 are switch member 246, insert cylinder up limit switch 250 that is resiliently retained in an open condition, a separating cylinder extended limit switch 251 that is resiliently retained in an open position, and the solenoid coil 253 of the bag opening cylinder control valve 254.

The time delay relay 234 has a coil 255 connected in series with a switch member 257 of limit switch 258 and switch member 256 across junctions 203, 213, coil 255 upon being energized will retain switch member 252 in a closed condition for a predetermined period of time and thence automatically move switch member 252 to an open condition, provided the coil is not deenergized prior to the expiration of said period of time.

Switch member 260 of limit switch 258 and a solenoid coil 262 of the solenoid operated air control valve 263 are connected in series across junctions 204, 215. A switch member 265 of bag opening cylinder limit switch that is resiliently retained in a open condition is connected across junctions 205, 266. Connected across junctions 266 and 216 is a solenoid coil 267 of a separating cylinder extended air control valve 268, junction 266 being connected by a line to junction 270.

Connected across junctions 206 and 270 is a normally open switch member 274 of a separating cylinder hold relay 272 while connected in series across junctions 270, 269 is the switch member 276 of an insert down limit switch 277, which is resiliently retained in a closed position, and the solenoid coil 273 of relay 272. Junction 270 is connected by a line to junction 266. Limit switch 277 also includes a switch member 278 that is resiliently retained in an open condition, switch member 278 and a switch member 287 of insert cylinder hold relay 297 being connected in series across junction 207 and 279.

Connected in series across junctions 208, 288 is the normally open switch member 282 of a case in position limit switch 283 and the normally open switch member 285 of a case stop hold relay 284, junction 288 being connected by a line to junction 279. Relay 284 includes a solenoid coil 286 connected across junction 288, 218 which, and as long as energized, moves and retains switch member 285 in a closed connection.

The switch member 289 of a bag opening extended limit switch is connected across junctions 209, 290, junction 290 being connected to junction 291. Connected in series across junctions 301, 219 is a second normally open switch member 292 of limit switch 283 and a solenoid coil 293 of the insert cylinder air control valve 294 while connected across junctions 301, 290 is a normally closed switch member 300 of relay 272.

A normally open switch member 296 of a relay 297 is connected across junctions 211, 291, the relay including a solenoid coil 298 which is connected in series with the normally open switch member 295 of the insert cylinder fully extended limit switch across junctions 235, 291, junction 291 being connected by a line to junction 290. A vacuum sensing switch 302 is connected across junctions 291, 301.

The pneumatic controls 304 include a source of air under pressure 305 that is connected through a shut-off valve 306 to a line 307 (see FIG. 16). Line 307 has junctions 308–314, 337, 420 and 398 thereon. Junction 314 is connected to ports 315, 317 of a case in position pneumatic limit switch 316. Limit switch 316 also includes an exhaust port 324, a port 320 and a port 321 together with switch members 318 and 319. Further, the limit switch 316 includes an operator **316*a* (see FIG. 14) that is resiliently retained in a position to maintain switch member 319 to fluidly connect port 321 to port 324, and switch member 318 to fluidly connect port 320 to port 317. However, when the operator 316*a* is moved to the position shown in FIG. 14 by case 160 being in position, switch member 319 breaks the above-mentioned fluid connection and fluidly connects port 321 to port 315 and moves switch member 318 to break its above-mentioned fluid connection and fluidly connect port 320 to port 324. Port 320 is fluidly connected to port 323 of cylinder 180 while port 321 is fluidly connected to port 322** of said cylinder.

Junction 309 is connected to an inlet port 327 of valve 254, valve 254 having a valve member 329, an exhaust port 328 and a port 326. When the coil 353 is energized a valve member 329 moves so that a fluid connection is established between port 326, 327 and exhaust port 328 is blocked, and when the coil is deenergized port 326 is connected to the exhaust port and port 327 is blocked.

Port 326 is fluidly connected to the down control port 331 of the bag opening cylinder control valve 330, valve 330 having a valve member 332, exhaust port 333, and an inlet port 334 that is connected to junction 337, a port 335 and a port 336. Valve member 332 is resiliently retained in a position to fluidly connect port 335 to port 333 and port 336 to port 334. When fluid under pressure is applied to port 331 and as long as fluid under pressure is applied thereto, valve member 332 fluidly connects port 336 to the exhaust port and inlet port 334 to port 335.

A combination of a check valve and flow restrictor 343 are connected in parallel between port 336 and junction 340, junction 340 being connected to a port 341 on one of the cylinders 70 and to a port 342 on the other of the cylinders 70. The flow restrictor-check valve combination permits free flow of air from port 336 therethrough to port 340 but blocks the flow of the air from port 340 through the check valve to port 336 while permitting the cylinders exhausting through the flow restrictor. The combination of a check valve and flow restrictor 347 are connected in parallel between port 335 and junction 344, junction 344 being connected to a port 345 on one of the cylinders 70 and a port 346 on the other cylinder 70. The combination permits free flow of air in a direction from port 335 to junction 344 but the check valve is oriented to block flow of air therethrough from junction 344 to port 345 while the flow restrictor controls the exhaust flow of air in the aforementioned direction.

Valve 263 has an exhaust port 350, an inlet port 351, a port 352 and a valve member 353. When the valve is energized the valve member moves to fluidly connect port 351 to port 352 and blocks the exhaust port, and when deenergized port 352 is connected to the exhaust port and inlet port 351 is blocked.

The vacuum control valve 356 has a control port 357 connected to port 352, a port 358 fluidly connected to the vacuum pump 234 and a port 359 connected by lines to the vacuum cups of the bag opening assembly and bag separating assembly 41 and 40 respectively. When fluid under pressure and as long as fluid under pressure is applied to the control port 357, port 358 is fluidly connected to port 359 to apply a vacuum to the vacuum cups, but when no fluid under pressure is applied to port 357, the valve member 360 is resiliently retained in a position to block fluid flow between ports 358, 359. Junction 311 is connection to junction 364 which in turn is connected to an inlet port 365 of the solenoid operated valve 268, and a port 374 of the separating cylinder control valve 371. Valve 268 also includes an exhaust port 366, an inlet port 367, and a valve member 368 that when the valve coil 267 is deenergized remains in a position to fluidly connect port 367 to the exhaust port and block port 365, and when energized fluidly connects ports 365, 367 and blocks the exhaust port.

Valve 371 also includes an exhaust port 373, a control port 372, a port 375, a port 376, and a valve member 377 that is resiliently retained in a position to fluidly connect port 375 to port 373, and port 374 to port 376. When fluid under pressure and as long as fluid under pressure is applied to the control port, valve member 377 fluidly connects port 374 to port 375 and port 376 to exhaust port 373. A combination of a flow restrictor and check valve 379 are connected in parallel between port 376 and a port 380 on the separating cylinder 50 while the combination of a check valve and flow restrictor 381 are connected in parallel between port 375 and a port 382 on the opposite end of the cylinder. The check valves are oriented to block fluid flow therethrough in a direction away from the respective cylinder port but permit free flow of fluid therethrough to the respective port.

The case stop retract valve 280 includes an inlet port 386, an exhaust port 387, a port 389 and a valve member 388 that when the coil 281 is deenergized remains in a position to connect port 389 to the exhaust port and block the inlet port 386 and when the coil is energized fluidly connects port 386 to port 389 and blocks the exhaust port.

Valve 391 includes a control port 392 connected to port 389, an exhaust port 393, a port 394 that is fluidly connected to a junction 444 which in turn is connected to junction 398, a port 395, a port 396, and a valve member 397 that is resiliently retained in a position to fluidly connect port 395 to the exhaust port and port 396 to port 394. When and as long as fluid under pressure is applied to the control port 392, valve member 397 establishes a fluid connection from port 393 to port 396 and from port 394 to port 395. Port 395 is connected to port 401 on one end of cylinder 166 while a port 400 on the opposite end of the cylinder is fluidly connected to port 396.

Valve 294 includes an inlet port 408 that is connected to junction 313, an exhaust port 409, a port 410 and a valve member 411 that when coil 293 is deenergized fluidly connects port 410 to 409 and blocks the inlet port and when the coil is energized fluidly connects port 408 to port 410 and blocks the exhaust port. Connected in parallel between port 410 and the control port 413 of the insert cylinder down valve 414 is a combination of a flow restrictor and check valve 412. The check valve is oriented to permit free flow of air therethrough from port 410 to port 413 but block the flow of air therethrough in the opposite direction. Valve 414 also includes an exhaust port 415, a port 416 connected to a junction 420, a port 417, a port 418 and a valve member 419 that is resiliently retained in a position to connect port 417 to the exhaust port and port 416 to port 418. However, when and as long as air under pressure is applied to the control port, the valve member fluidly connects port 418 to the exhaust port and port 417 to port 416.

Port 418 is connected to the junction 425, a combination of a flow restrictor and check valve 426 being connected in parallel between junction 425 and a port 427 of cylinder 101. The check valve is oriented to permit free flow of air therethrough from junction 425 toward port 427 but block flow of air therethrough in the opposite direction. The opposite end of the cylinder has a port 428, there being a combination of a flow restrictor and check valve 429 connected in parallel between port 428 and port 417. The check valve of combination 429 is oriented to permit free flow of air from port 418 toward port 428 but block flow of air therethrough in the opposite direction.

Junction 425 is connected to one leg of a T connector 431, the second leg of T connector being connected to a control port 432 of an air control valve 433 and a third leg of the connector being connected through an adjustable air flow restrictor 442 to a second control port 436 of valve 433. Valve 433 also includes exhaust ports 434 and 435, an inlet port 441 that is connected to a junction 444, a port 437 that is connected by lines to ports 440 on the one ends of the cuffing cylinders 123 and a port 438 that is connected by lines to ports 439 on the opposite ends of the cuffing cylinders. The valve 433 is of a conventional construction. Valve 433 is a construction that when the air under pressure at ports 436, 432 is substantially equal, port 438 is fluidly connected to exhaust 434 while the exhaust port 435 is blocked. However, when the air pressure at port 432 is significantly greater than at port 436, the valve member (not shown) of valve 443 fluidly connects port 438 to port 441 and port 437 to exhaust port 435. The flow restrictor 442 is provided to control the rate of flow of air from T connector 431 to port 436 so that the pressure at port 436 will not be substantially equal to that at port 432 for a preselected period of time after the time air under pressure is initially applied to T connector 431 or air under pressure is exhausted through the T connector as will be described hereinafter.

A description of the first embodiment having been set forth, the operation thereof will be set forth. With the power off, upon opening valve 306 air under pressure is applied through valve 330 to ports 341, 342 of the bag opening cylinders 70 so if the piston rods are not already in their extended position, they are moved to their extended position and switch member 265 of the bag opening retracted limit switch is open. Further, air under pressure is applied through valve 371 to port 380 of the separating cylinder 50 to retract its piston rod if it is not already in a retracted position. With the separating cylinder piston rod in the retracted position, the switch members 257 and 259 of the separating cylinder limit switch 258 are closed and switch member 260 is open. Also air under pressure is applied through valve 414 to port 427 of the insert cylinder 101 to retract the insert cylinder piston rod and thereby move the bag insert assembly to its elevated position, the insert assembly in its elevated position closing insert cylinder up limit switch 250.

With power applied across lines $L_1$, $L_2$, the start switch 223 is depressed long enough to energize coil 232 of the vacuum pump motor starter 248 to complete the circuit for energizing the vacuum pump motor and to close its switch member 236 to provide a hold in circuit to maintain the starter energize when the start switch is released to resiliently return to its open position. At the same time that starter relay 248 is energized, the conveyer motor starter relay 245 is energized to through conventional circuitry provide power to energize the conveyer motor 231 for driving the conveyer belt. The energization of coil 230 of the conveyer motor starter relay also closes switch member 229.

Assuming at the time the conveyer motor is energized, case 160, case 183 and other cases with their foldable top flaps extending vertically upwardly are located on the upper run of the conveyer belt more remote from the case clamp 182 than the case stop assembly 161 in a direction opposite arrow 176, switch members 318, 319 of the case clamp switch 316 are resiliently retained in a position to apply air under pressure to port 323 of cylinder 180 to hold clamp 182 in a retracted position. Further, at this time no case engages the operator 325 of the case in position limit switch 283 and as a result switch members 282, 292 of the limit switch are resiliently retained in an open condition. Upon case 160 being moved in the direction of arrow 176 by the driven upper run of the conveyer belt in advance of the clamp cylinder to engage operator 316*a* of switch 316, the switch members 318, 319 are moved to apply air under pressure to port 322 of cylinder 180 whereupon the clamp 182 is moved clampingly to hold case 183 against the side rail 145 to prevent case 183 and the cases rearwardly thereof being moved along with the conveyer upper run. In this connection switch 316 is located so that case 160 will have moved in advance of the clamp 182 prior to the clamp moving to its extended position to engage case 183. As case 160 moves into engagement with stop plate 173, it engages the operator 325 of case in position limit switch 283 whereby switch members 282, 292 are moved to their closed positions and are retained in closed positions as long as the operator 325 abuts against case 160, or another case.

Figure 17:
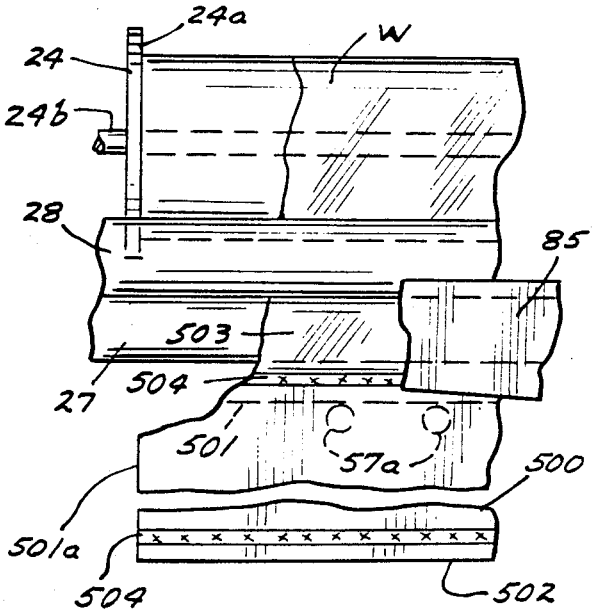
FIG. 17 is a fragmentary transverse cross sectional view showing the bag roll web relative the separation plate and pinch roll, said view being generally taken along the line and in the direction of the arrows 17—17 of FIG. 1 other than the bag guide is not shown and portions of the web are broken away.

Before further describing the operation of the first embodiment, and with reference to FIGS. 1 and 17, the bag roll on reel 24 has a web W of perforated flat folded tubular roll stock of many bags in gusseted or flat formed joined together in end-to-end relationship along transverse perforated lines 501. The leading edge 502 of the web constitutes the bottom edge of the first (leading) bag 500, bag 500 having a transverse seal 504 extending thereacross to form the bag bottom closure. The top edge of the bag 500 is joined to the bottom edge of bag 503 along perforated line 501 which is closely adjacent the bottom seal closure 504 of bag 503.

With rod 34 manually moved to pivot the pinch roll 28 about pivots 31 to the position shown in FIG. 6, latch 35 pivots to the solid line position of FIG. 6 to hold roll 28 spaced from roll 27. Now the leading edge portion of bag 500 is pulled to unroll the web from the reel sufficiently so that the bag 500 will extend between pinch rolls 27, 28 and then the latch pivoted to allow roll 28 to hold bag 500 in abutting relationship with roll 27.

Upon the conveyer motor starter relay switch member 229 being moved to a closed position, a circuit is completed to energize the pinch roll feed motor 70 to rotate pinch roll 27 and through the gears 135, 136 rotate pinch roll 28 so that the bag web W is pulled off the bag roll and the leading terminal edge 502 thereof fed downwardly between the pinch roll 27 and the separating plate 85, thence downwardly between the vacuum cups 54 and 75 and strips 57, 81, and thereafter downwardly between the legs 93*a*, 94*a* and legs 93*c*, 94*c* of the bag guide until leading terminal edge 502 of bag 500 of the web interrupts the beam of light of the photocell unit 237. Upon the beam of light of the photocell unit being interrupted by bag 500, it operates its switch member 240 to a closed condition to complete the circuit for energizing the bag feed stop relay 243. The energization of relay 243 opens switch member 247 to break the circuit energizing the feed motor 70 and thereby stops further feed of the bag roll web with line 501 of bag 500 at or slightly below the elevation of separation plate apex 85*a*. Further, switch member 256 is moved to an open condition to deenergize the coil 255 of the bag safety timer 234. In the event that the coil 255 is not deenergized within a preselected period of time after it is initially energized, it will automatically operate switch member 252 to an open condition which deenergizes the vacuum pump motor starter relay 232 and thereby shuts off the power to the electrical controls of the bag inserter machine. This is a safety feature to prevent the web of the bag roll being continuously fed from the bag roll in case the web does not move downwardly between legs 93*a*, 94*a* and 93*c*, 94*c* of the bag guide to operate the photocell unit.

Further, the energization of the bag feed stop relay results in switch member 246 moving to a closed position to complete a circuit for energizing the solenoid coil of the bag opening cylinder retract valve 254. Upon coil 253 being energized, valve member 329 moves to apply air under pressure to control port 331 of valve 330 which in turn moves its valve member to apply air under pressure to ports 345, 346 of the bag opening cylinders 70. The bag opening cylinder piston rods in retracting move the angle iron 62 and thereby vacuum cups 75 and rubber strip 81 to abut against the side wall of the most advanced bag (bag 500) on the bag roll web that is opposite the bag separating assembly The vacuum cups and rubber strip 81 moving in the aforementioned manner move the opposite side wall of the most advanced bag into abutting relationship with the rubber strip 57 so that the most advanced bag 500 is clampingly engaged between rubber strips 57, 81 while the perforations 501 of bag 500 joining the bag to the remainder of the web (to bag 503) are above the vacuum cups and at substantially the elevation of the apex 85*a* of the separating plate 85.

At the time the bag opening assembly is moved so that the advanced bag is clampingly engaged between rubber strips 57, 81 it moves the bag opening retracted limit switch member 265 to a closed condition for energizing the separating cylinder hold relay 272 and the solenoid coil 267 of the separating cylinder extend control valve 268. The energization of relay closes switch member 274 to provide a hold-in circuit for maintaining the relay energized and opens switch member 300. The energization of control valve 268 results in its valve member moving to apply air under pressure to control port 372 of valve 371 which in turn results in its valve member moving to apply air under pressure to port 382 of the separating cylinder 50 for moving its piston rod 49 to an extended position (dotted line position of FIG. 3).

The bag separating assembly in being moved toward its extended position (direction of arrow 400) forces the bag opening assembly to move in the same direction against the resistence of air under pressure in cylinders 70. This results in the part of bag clamped by the rubber strips that extends above the rubber strips being moved from rearwardly of the separating plate to a position forwardly of the separating plate. Since the bag roll web cannot move in a bag feeding direction due to the weight of the upper pinch roll clamping the bag roll web against the lower pinch roll the forward movement of the bag opening and separating assemblies results in bag 500 being separated from the bag roll web along its perforations 501 as the bag web is moved by being clamped between the rubber strips into abutting engagement with the separating plate. The shallow V-shaped lower edge of the separating plate results in the bag normally being initially separated at its center and thence outwardly towards either edge of the web. The edge of bag 500 that was joined to bag 503 defines the bag mouth edge of bag 500.

As the separating assembly moves from its retracted position towards its extended position, it moves out of engagement with limit switch 258 whereby switch members 257, 259 move to an open condition and switch member 260 moves to a closed position. Switch member 260 in moving to a closed condition energizes the solenoid coil of the vacuum solenoid control valve 263 whereupon its valve member moves to apply air under pressure to port 357 of control valve 356. As a result, valve member 360 moves to establish a fluid connection between the vacuum pump and the cups of the bag opening and separating assemblies which thereupon grippingly engage the adjacent opposite side walls of the separated bag or the bag that is in the process of being separated from the bag roll web. For example the dotted line representation 57*a* of two cups 57 in FIG. 17 represents position bag 500 is grippingly engaged by these cups which is just below perforated line 501 (top edge) of bag 500. The transverse spacing of the cups from the side edges 501*a* of bag 500 will depend on the width of the flattened rolled bag on the reel, whether or not the bag is a gusseted bag and the dimensions of the bag top opening to be formed to permit the insert assembly being moved thereinto. That is the cups 54, 75 at the transverse opposite ends of assemblies 40,41 are located sufficiently spaced from edges 501*a* and intermediate said edges so that upon cups 75 being moved to their bag opening position the longitudinal dimension of the opened bag top will be slightly greater than the corresponding spacing of the longitudinal remote vertical surfaces of the tube portions 119*a* and the transverse spacing of the last-mentioned cups is sufficiently great that the bag top opening will be of a slightly greater transverse dimension than the corresponding transverse spacing of the transversely remote vertical surfaces of tube portions 119*a*.

In the event that all of the cups do not properly grippingly engage the adjacent bag side wall to block air inflow into the cups vacuum switch 302 remains in an open condition to prevent insert control valve 294 being energized and thereby prevent air under pressure being applied to the insert cylinder for moving the bag insert assembly in a downward direction. This is a safety feature in that the insert assembly will not be moved downwardly unless the bag is properly grippingly engaged by the vacuum cups whereby switch 302 closes.

After vacuum has been applied to the vacuum cups and as the separating cylinder moves adjacent its extended position, the separating assembly engages the separating cylinder extended limit switch to move its switch member 251 to an open position. This deenergizes the bag opening cylinder retract control valve 254 whereupon control port 331 is connected to the exhaust and valve member 332 of valve 330 is resiliently moved for applying air under pressure to ports 341, 342 of the bag opening cylinders and thereby move their piston rods to an extended position. Since the bag separating assembly remains stationery in its extended position, as the bag open assembly is moved away from the bag separating assembly, the bag top mouth of separated bag 500 is open. Further, as the bag top portion of the bag is being opened, the lower terminal edge 502 of the bag 500 is moved out of the beam of light of the photoelectric cell unit whereupon the bag feed stop relay 243 is deenergized. This results in switch members 247, 256 closing and switch member 246 opening. However, the pinch roll drive motor is not energized at this time since switch member 259 is open.

As the bag opening assembly moves to its extended position, it operates the bag opening extended limit switch 289 to a closed position for a sufficient period of time to energize the insert cylinder hold relay 297 to move its hold-in switch member 296 to a closed position and move its switch member 287 to an open position, and thence limit switch member 289 moves to an open position. In the event a case 160 on the conveyer belt is not in proper position to have a bag inserted therein, the switch members of the case-in-position limit switch 283 remain in an open condition and further operation of the machine stops until case 160 has been moved to a position for closing said switch members. With the case 160 in proper position, at the time the insert cylinder hold relay was energized or at a time subsequent thereto that a case causes switch member 292 to move to a closed position, the solenoid coil of the insert cylinder down control valve 294 is energized. The energization of valve 294 results in its valve member 411 moving to apply air under pressure to control port 413 of valve 414 for moving valve member 419 to apply air under pressure to port 428 of the insert cylinder 101 so that its piston rod 102 and the structure mounted thereon moves downwardly. As the piston 102 moves downwardly the insert cylinder up limit switch 250 moves to an open position. Further, downward movement of the piston rod 102 moves the insert tubes 119 into the open mouth of the bag 500 while the open bag is being grippingly engaged by the vacuum cups and downwardly in the bag to pull the bag out of the bag guide and over rod 92.

Due to curvature of tube portions 119*b*, the entry of tubes 119 into the bag is facilitated. As the tubes move downwardly the horizontal cross sectional area defined by the parts of the tubes extended into the bag progressively increases until tube portions 119*a* start to enter into the bag.

When the bag insert assembly has been moved intermediate its retracted position and its fully extended position and extends into the bag, it engages insert cylinder limit switch 277 to operate said limit switch to move its switch member 276 to an open position for sufficient period of time that the separating cylinder hold relay 272 is deenergized and its hold-in circuit through switch member 274 is opened and then its switch member 276 again moves to a closed position. The deenergization of relay 272 results in the separating cylinder extended solenoid valve 268 being deenergized, whereupon port 382 of cylinder 50 is connected to the exhaust and air under pressure is applied to port 380. However due to the provision of the flow restrictor-check valve combination 381, the separating assembly moves only a short distance toward its retracted position prior to the bag on the insert assembly being moved to its fully case inserted position or the case being stripped off the vacuum cups as will be described hereinafter.

When the piston rod 102 of the insert cylinder moves to its fully extended position, it opens limit switch member 295 of the insert fully extended limit switch which results in the insert cylinder hold relay 297 being deenergized. This closes switch member 287 and opens switch member 296 to deenergized the insert cylinder down control valve 294, it being noted that limit switch 289 is in an open condition at this time. The deenergization of valve 294 results in control port 413 of valve 414 being connected to the exhaust and valve member 419 resiliently urged to a position that air under pressure is applied through junction 425 to port 427 of the insert cylinder 101 to start the elevating of the piston rod thereof, and to the T connector 431. Air under pressure at the T connector applies air under pressure to port 432 of valve 433 to move its valve member to connect port 441 to port 438 and therethrough to port 439 of the cuffing cylinders and port 437 to port 435 so that piston rods thereof are extended. At the same time air under pressure is being applied through port 432 air is bleeding through flow restrictor 442 toward port 436. After the piston rods of the cuffing cylinders have moved to their fully extended position the spring (not shown) of valve 433 in conjunction with the air under pressure from T connector 431 flowing through the flow restrictor 432 building up to be sufficiently great moves the valve member of valve 433 to connect port 439 to the exhaust 434 and port 441 through port 437 to port 440 of the cuffing cylinders to start the retraction of the cuffing cylinder piston rods. Due to the size of the insert cylinder relative the cuffing cylinders and the provision of the flow restrictor-check valve combination 429, the cuffing cylinder piston rods are moved to their fully extended position prior to any significant amount of retraction of the insert cylinder piston rod.

Figure 13:
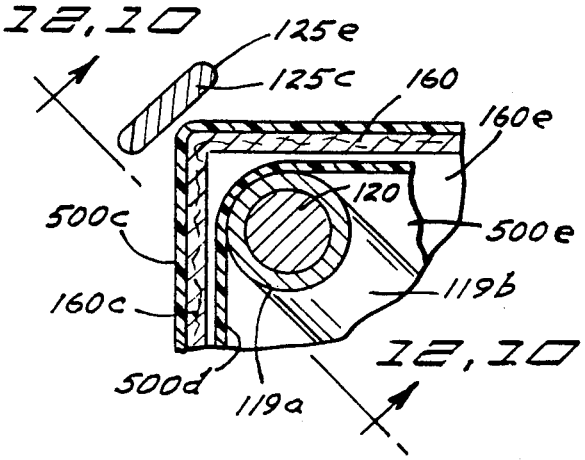
FIG. 13 is a fragmentary transverse cross sectional view generally taken along the line and in the direction of the arrow 13—13 of FIG. 12 to show the relationship of a cuffing finger relative a corner of a case in a finger extended position.
Figure 11:
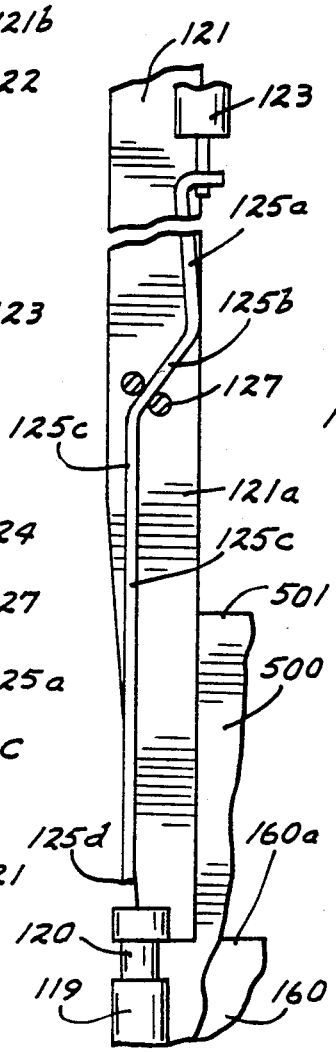
FIG. 11 is a view corresponding to FIG. 10 other than it shows the cuffing finger in a retracted position.
Figure 12:
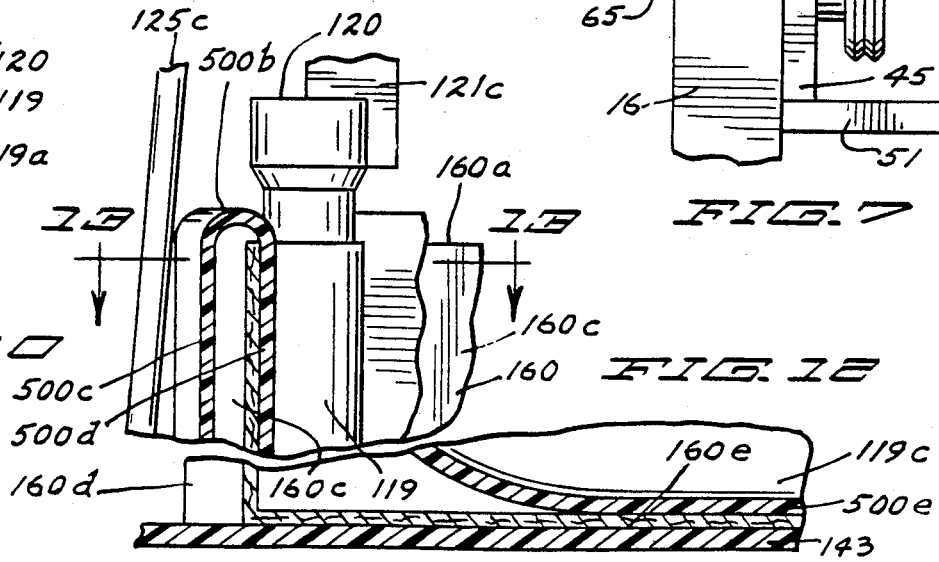
FIG. 12 is an enlarged fragmentary view showing the cuffing finger after the bag has been cuffed over the upper edge portion of a case, said view being generally taken along the line and in the direction of the arrows 12—12 of FIG. 13.
Figure 8:
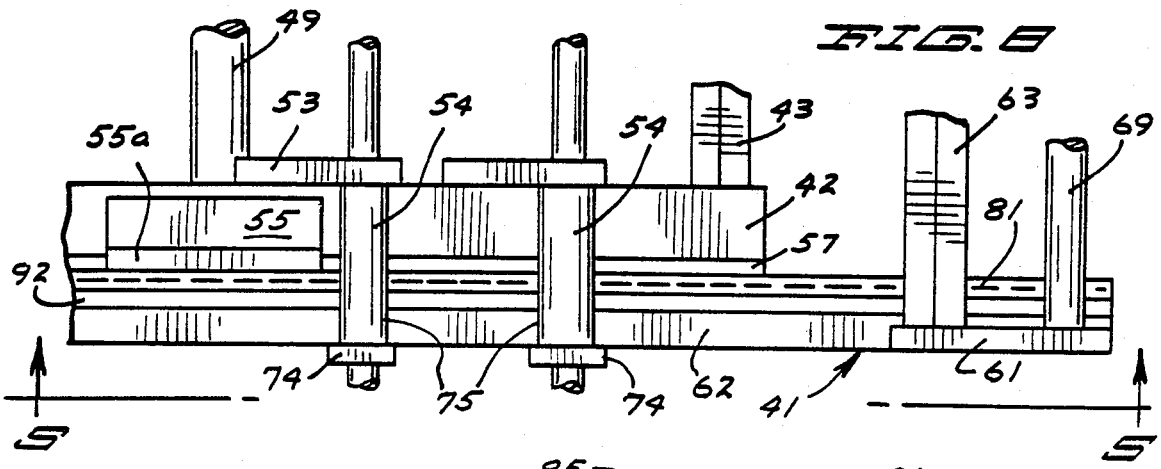
FIG. 8 is a fragmentary plan view of the vacuum cup assemblies shown in the solid line position of FIG. 3.
Figure 9:
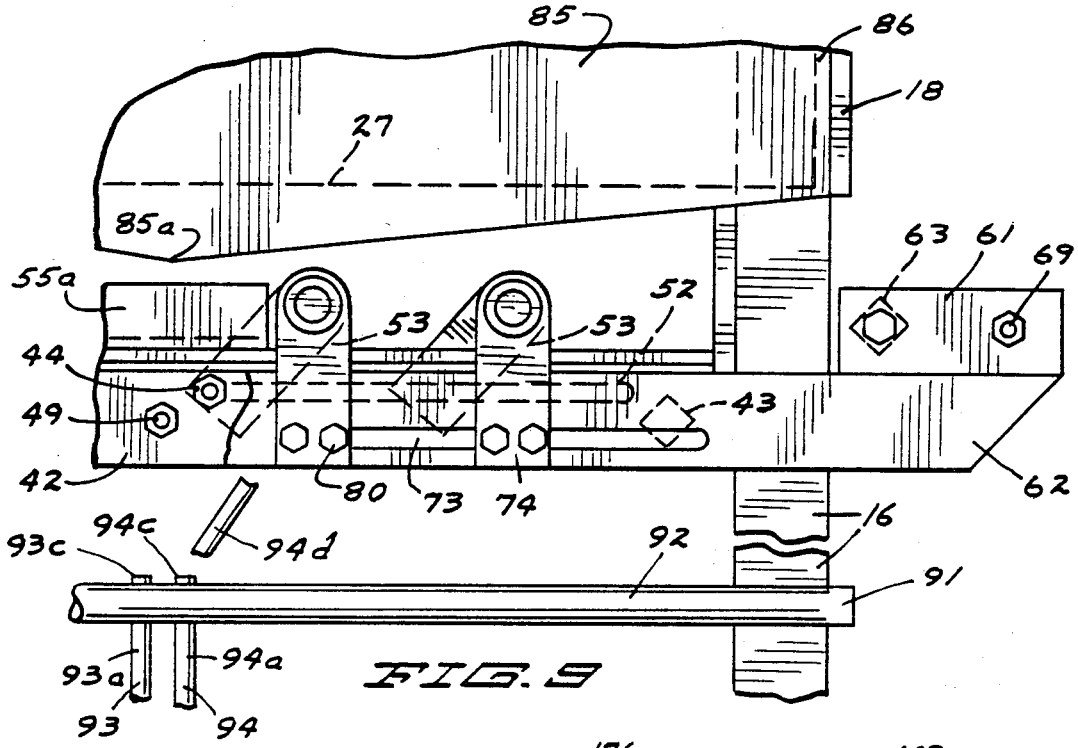
FIG. 9 is a fragmentary front view generally taken along the line and in the direction of the arrows 9—9 of FIG. 8.

At the time the insert cylinder piston rod moves to its lowermost elevation the bottom 500*e* of the bag 500 is in abutting relationship with the bottom 160*e* of case 160 while the top edges 160*a* of the vertical open top flaps of the case are at a slightly higher elevation than the top of tube portions 119*a* and the top edge 501 of the open bag mouth of bag 500 is at a substantially higher elevation than the case flap top edges 160*a* and the lower terminal ends 125*d* of the cuffing fingers 125 (see FIG. 11). Further, the lower parts of cuffing finger portions 125*c* are located within the interior of the bag and are at a higher elevation than the top flap edges 160*a*. When the cuffing cylinder piston rods 124 initially move downwardly, due to cuffing finger portions 125*b* being located between the rollers 126 and 127, cuffing finger portions are moved both downwardly and horizontally more remote from the central axis of the insert cylinder rod 102. Prior to the cuffing finger terminal ends 125*d* being moved to a lower elevation than the top edges 160*a* of the case, the terminal ends 125*d* have been moved horizontally to be more remote from the adjacent corners of the case formed by the open top flaps than the spacing of the respective corner from the central axis of the piston rod 102. As a result further downward movement of the cuffing cylinder piston rods moves the cuffing fingers so that portions 125*a* move between rollers 126, 127 and the terminal ends then move nearly directly downwardly in abutting relationship with the upper part of the bag top. This forces the upper part of the bag downwardly over edges 160*a* and down along the exterior surfaces of the open flaps whereby the bag top terminal edge 500*a* is moved progressively further downwardly and more closely adjacent finger terminal ends 125*d* with part of the bag top portion on the side of the fingers opposite tube portions 119*a* and part between finger portions 125*c* and tube portions 119*a* (see FIG. 18). At the same time the tubes 119 retain the lower part of the bag in position within the interior of the case 160. When the cuffing fingers are at their lowermost elevation, the bag has parametric portions 500*b* reversely bent over the case flap edges 160*a* with bag side wall portions 500*d* being located between the bag top flaps 160*c* and the tube portions 119*a*, cuffed bag top portion 500*c* located between the bag top flaps 160*c* and the cuffing finger portions 125*c* (FIGS. 12 and 13) and the terminal edge 501 of the bag top located at a lower elevation than the case flap edges 160*a* but at a higher elevation than the terminal ends 125*d* of the cuffing fingers in their lowermost positions. When the cuffing fingers are retracted no substantial movement of the bag portion 500*c* takes place with the retraction of the cuffing fingers. As may be noted with reference to FIG. 13, the cuffing finger portions 125*c* extend at about a 45° angle relative the corner formed by the adjacent parts of two open case top flaps 160*c* that define a corner portion between the finger and the tube portions 119*c* with one vertically extending edge 125*e* of the finger being more remote in the fore and aft direction from the central axis of the piston rod 102 than one case flap 160*c* and the opposite edge 125*e* being longitudinally more remote from the piston rod 102 than the other flap 160*c* of the case that forms the adjacent corner. Likewise the corresponding edges 125*e*, 125*e* of the other fingers are located in a similar manner relative the corner portions of the case that they are located adjacent to so that only four fingers are required for cuffing the open end portion of the bag over the open case top flaps.

Rod 92 is located at a lower elevation than the bag separating and opening assemblies, at a higher elevation than the top edges of the vertical open case top flaps of the cases on the conveyer assembly, longitudinally on the opposite side of the separating plate 85 from pinch roll 27, and longitudinally intermediate the separating plate 85 and the case side wall 160*d* abutting against side rail 145, but preferably only a relatively small longitudinal distance from said side wall. Further, the rod is of a greater transverse width than the corresponding dimension of the bag prior to the bag being opened. As a result the bag web fed downwardly by the pinch rolls may extend to a lower elevation than the top edges of open case top flaps and retained out of the path of movement of cases as the conveyer assembly by the bag guide. If the guide were not provided, for example strong air currents may move the bag into the path of movement of a case. Also when a separated bag is being moved into a case, the part of the bag that extends below rod 92 and in the bag guide is moved over the rod to be at a higher elevations than the case flap top edges so that it will not move the flap of the side wall abutting against rail 145 to a closed position or into the interior of the case as the insert assembly is moved downwardly.

As the insert assembly is retracted to a position intermediate its datum elevated position and its fully extended down position, it again operates the insert cylinder down limit switch 277 to open switch member 276 which at this time does not perform a function, and close limit switch member 278. Since at this time relay switch member 287 is closed, the closing of switch member 278 energizes the case stop hold relay 284 long enough to close switch member 285 to form a hold-in circuit as long as case 160 abuts against operator 325; and energizes coil 281 of the case stop retract valve 280. The energization of valve 280 results in air under pressure being applied to control port 392 of valve 391 to move its valve member for applying air under pressure to port 401 to retract piston rod 167. The retraction of piston rod 167 results in stop plate 173 being moved out of engagement with case 160. Now the conveyer moves case 160 in the direction of arrow 176 and as soon as the case has moved out of contact with the operator 316*a* of the clamp valve 316, the valve member of the clamp valve resiliently moves to apply air under pressure to port 323 of the clamp cylinder 180 for retracting piston rod 181. This allows case 183 to move with the conveyer belt.

When case 160 has been moved in advance of operator 325 it resiliently moves so that switch members 282, 292 move to an open condition and since switch member 278 is open at this time the case stop relay is deenergized. With reference thereto the insert assembly moves upwardly relative to limit switch 277 so that switch member 278 opens and switch member 276 closes prior to case 160 being moved in advance of the operator 325.

Prior to relay 284 being deenergized, the case 183 is moved into engagement with the operator of valve 316 so that air under pressure is applied to clamp cylinder port 322 to move the clamp pad 182 into abutting relationship with the case that was immediately trailing case 183 to stop it to be about a case length away from case 183 when case 183 abuts against the stop plate 173. When case 160 moved out of engagement with operator 325 and the case stop retract valve 280 was deenergized, control port 392 was connected to exhaust 387 and the valve member of valve 391 moved so that air under pressure was applied to port 400 whereby piston rod 167 was moved to its extended position and the stop plate 173 moved into the path of movement of the oncoming case 183 in a manner previously described with reference to case 160. Case 183 in moving against the stop plate moves the operator 325 to close switch member 282, 292 as previously described.

At the time the insert assembly in moving downwardly into case 160 resulted in switch member 276 being moved temporarily to an open position the separating cylinder hold relay 272 was deenergized as was the separating cylinder extend control valve 268. As a result of valve 268 being deenergized port 372 of valve 371 was connected to exhaust 366 and valve member 377 resiliently moved to an open condition for applying air under pressure to port 380 of the separating cylinder 50. As a result the separating cylinder piston rod started to retract the separating assembly but due to the provision of the flow restrictor-check valve combination 381 the rate of retraction was not sufficient to tear the bag off the vacuum cups or move the separating assembly vacuum cups out of gripping engagement with the bag prior to the insert cylinder in moving downwardly to the bottom of the bag and stripping the bag out of gripping engagement with the vacuum cups. In this connection it is to be noted that the application of vacuum to the vacuum cups is controlled so that the bag top will not be held with sufficiently great force to tear the bag as the insert assembly moves into engagement with the bottom of the bag and thereby strip the bag from the cups but at the same time hold the bag with a sufficient gripping force so that the bag is not stripped out of gripping engagement with the vacuum cups prior to the insert assembly engaging the bottom part of a bag.

When the separating cylinder has moved to its retracted position, it operates separating cylinder retract limit switch 258 to through switch member 259 energize the pinch roll feed motor 70 move the web one bag length whereupon it breaks the beam of light of the photocell unit and the operation of the machine continues as has been previously described. However, it is to be noted that the bag opening cylinder retract control valve 254 cannot be energized until the insert assembly has been moved up to its datum position to close switch 250 of the insert cylinder up limit switch. This is to prevent the bag opening assembly moving into engagement with the insert assembly.

With reference to the above operation, it is to be noted that a bag web can be fed down into a bag holder prior to the bag insert assembly being returned to its retracted datum position. The time delay relay is set such that if the machine is operating properly, it will not open its switch member even though there is a short delay between the time a second bag 503 that is still joined to the bag web is fed downwardly into the bag guide 93, 94 and a second bag being separated from the bag web even though at the time the second bag is fed into the bag guide the insert cylinder piston rod has not been fully retracted.

Figures 18, 19:
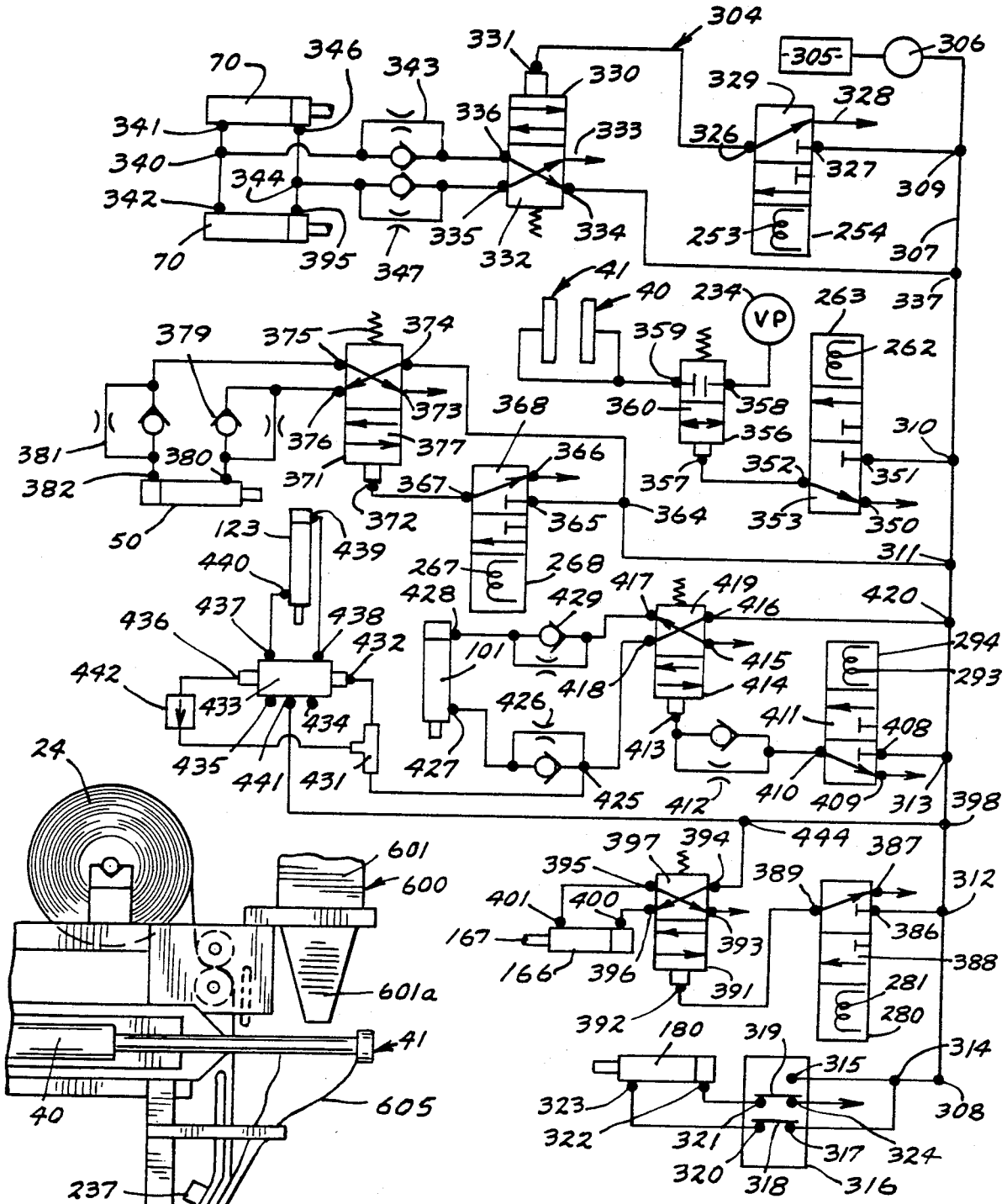
FIG. 18 is a view similar to FIG. 12 other than it shows a cuffing finger intermediate its retracted position and its fully extended position of FIGS. 10 and 12.
FIG. 19 is a view corresponding to FIG. 1, other than it is of a second embodiment of the invention.

Referring now to FIG. 19, the second embodiment of the invention, generally designated 600, will now be described. The second embodiment of the invention is the same as the first embodiment other than that the second embodiment does not include a bag insert assembly. Rather, a hopper scale assembly 601 is mounted on the frame of the insert machine such that the discharge spout 601*a* of the assembly will discharge product into the bag 605 that is being held open by the vacuum cups of the bag separating and the bag opening assemblies in the separating assembly extended and bag opening assembly bag open positions when a case is being held in position by the stop plate 173 directly below and centered horizontally relative the discharge spout. Even though prior to the time product is discharged into the bag a portion of the bag 605 is extended over a rod 92 and into the bag guide, the weight of the product falling into the part of the bag that is horizontally on the side of the rod 92 overhanging the case will pull the bag completely out of the bag guide so that the bottom of the bag is directly above the open case. The vacuum to the vacuum cups can be adjusted so that the weight of the product in the bag will strip the bag off the vacuum cups without tearing the bag whereupon the bag with product therein will fall into the open case on the conveyer beneath the hopper assembly. Alternately, the hopper dump circuit can provide a signal to operate the controls for discontinuing the application of vacuum at the vacuum cups just after the product is discharged into the bag.

Instead of the hopper spout assembly being mounted on the frame of the insert machine, it may be mounted on a separate frame with the spout located directly above a case stopped by the stop plate 173 and the vacuum cups operated in the aforementioned manner. In either event, the controls can be modified so that upon the discontinuance of the application of the vacuum to the vacuum cup or a bag being stripped from the cups, a switch is operated to deenergize the separating cylinder hold relay and the insert cylinder up limit switch would be eliminated.

In the event a case of a greater longitudinal dimension than the case shown in FIG. 1 is to have a bag inserted therein the side rail 152 is adjustably moved in the direction of arrow 400, the hand crank 79 turned to move cylinder 70 in the direction of arrow 400, a reel having bag roll stock of a greater transverse dimension (if not gusseted type) is provided on mounts 25, the positions of the vacuum cups on the angle irons adjusted if necessary and the position of the separating cylinder extended limit switch adjusted. Also the front two tubular portions and spacers are replaced with ones having tubular portions 119*c* of greater length and extending at a smaller diverging angle than the ones shown in FIG. 2 are mounted on the insert assembly. If a case of a greater depth is to have a bag of a greater height inserted therein the photocell unit is moved downwardly on the bag guide 90.

If a case of a greater transverse dimension than that shown in FIG. 2 is to have a bag inserted therein, plunger tubes have portions 119*c* of greater lengths and spacers are mounted on plate 115 so that the transverse spacing of tubular portions 119*b* from the central axis of piston rod 102 is greater but the longitudinal spacing remains the same, plate 164 is adjustably secured to angle iron 162 to the right of that shown in FIG. 14 so that the case will be stopped centered relative piston rod 102, and limit switch 283 correspondingly adjustably positioned, the case clamp assembly 178 and switch 316 to the left of that shown in FIG. 14, a reel having a bag roll of bags of a greater transverse folded dimension provided on mounts 25, and at least the transverse outer most cups 54, 74 move remotely spaced on the respective cup mounting member 42, 62.

Referring now to FIGS. 20–24, the third embodiment of the invention, generally designated 700, is the same as either the first or second embodiments except for the differences noted hereinafter. The third embodiment includes longitudinal frame members 701 extending between and mounted by the vertical frame members 11, 16 at either side of the machine to mount a horizontal mounting plate 702 at about the same elevation as plate 51. Tie plates 703 at their lower ends are bolted to the mounting plate and at their upper ends to the front end portion of the respective side plate 706. The rear ends of the side plates are mounted to the adjacent frame member 11 by brackets (not shown).

The side plates mount rollers 66, 67 (only roller 67 shown in FIG. 20) of the bag opening assembly, generally designated 708, in the same relationship for mounting guide rods 63 as described relative the first embodiment other than for being on the transverse opposite sides of side plates 706. Piston cylinder combinations 69, 70 are mounted by side plates 706 as described relative the combinations being mounted by plates 64 of the first embodiment except on the opposite sides of plates 706. Each piston rod 69 is secured to the respective tab 61 to extend rearwardly thereof as is each guide rod 63. The tabs mount a transversely elongated angle iron 709 which in turn mounts a resilient strip 81 and cup mounting bars 74 as per the first embodiment.

Each of bars 74 mounts a vacuum cup mount 710 which in turn mounts a vacuum cup 711. Each cup mount mounts a lug 712 to extend radially away therefrom. Each lug has a longitudinally elongated bumper mount 713 threaded therein for mounting a resilient bumper 714, for example of rubber, at one end thereof. The bumpers are mounted to extend to a slightly higher elevation than the uppermost portions of the cups and are radially offset from the respective cup mount by the same amount but adjacent thereto.

The bag separating assembly, generally designated 720, includes a pair of spaced side plates 721 mounted by mounting plate 702 to extend thereabove. Plates 721 are parallel to one another and are elongated to extend diagonally rearwardly at a small angle, for example about 3° to 7°, to a longitudinal direction. Preferrably the angle is about 7°. A separating tie plate 722 is mounted by the upper edge portions of plates 721.

Guide rods 724 that are of the same cross section as rods 43 are mounted by rollers 46, 47 (only rollers 47 shown in FIG. 20) by plates 721 in the same manner as described relative members 43, 45–47 of the first embodiment. Thus rods 724 are mounted for movement in a direction parallel to the direction of elongation of plates 721. The guide rods 724 have shims 725 (or other appropriate structure) on the forward ends thereof whereby angle iron 742 is mounted by the guide rods to extend close to a 90° angle to the rods, for example at about 83°, and parallel to angle iron 709.

The cylinder 728 of the piston cylinder combination 728,729 is mounted on plate 702 for moving its piston rod 729 in a direction parallel to the direction of elongation of plates 721. The piston rod is connected to angle iron 742 to move it therewith. The angle iron 742 of the third embodiment mounts vacuum cup mounting bars 53 as described with reference to the first embodiment, and a resilient strip 730 to extend the length thereof.

Each bar 53 mounts a cup mount 731 which in turn mounts a vacuum cup 732. Further each cup mount mounts a lug 733 which in turn mounts an elongated threaded bumper mount 734. The bumper mounts mount resilient bumpers 735 which are the same as bumpers 714.

Even though not shown, the vertical and longitudinal spacing of the separation plate, the pinch rolls, the bag guide assembly, the inserter assembly and the conveyor assembly of the third embodiment relative to the angle iron 42 of the bag separating assembly in its retracted position advantageously is the same as that of the corresponding parts of the first embodiment. Further, even though not shown, the plates 17, 18 for mounting the pinch rolls and other structure mounted thereon may be mounted by side plates 706 as well as the feed reel mounts 25. Further plate 130 may be mounted by frame member 13 to extend transversely away therefrom on the opposite side thereof and still mount the same structur referred to relative the first embodiment. Additionally, the inserter assembly may be mounted by a transverse frame member mounted by frame members 16 rather than by plates 17, 18.

Figure 20:
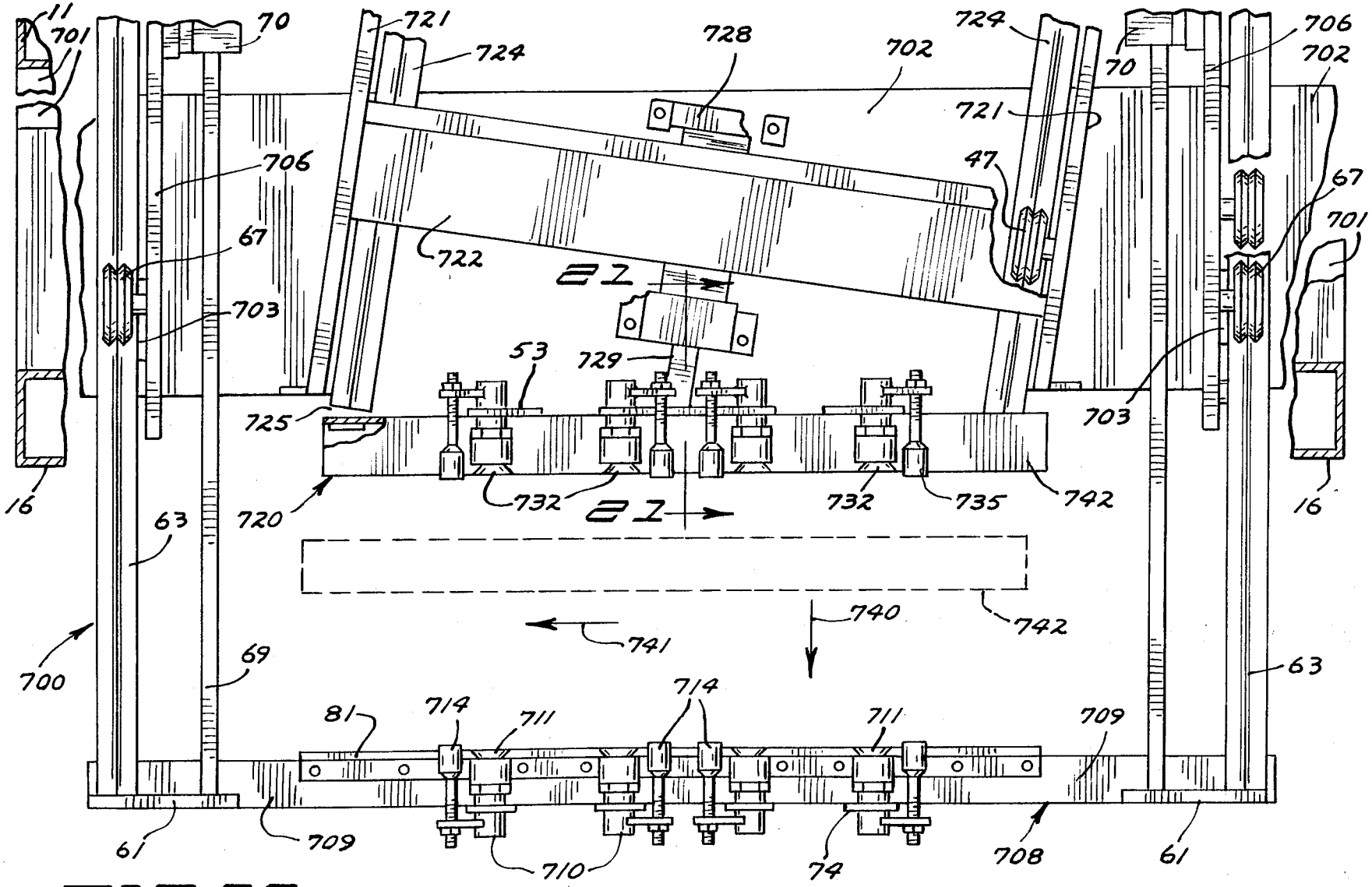
FIG. 20 is a fragmentary plan view of the bag opening and separating assemblies of the third embodiment of this invention with parts broken away, said view showing said assemblies in their datum positions in solid lines and the bag separating assembly angle iron in its extended second position in dotted lines.

Prior to using the third embodiment, the vacuum cups 711, 732 are transversely adjusted to be in direct longitudinal alignment when the bag opening and bag separating assemblies 708, 720 are in their datum positions shown in solid lines in FIG. 20. Further the bumpers of assembly 708 are longitudinally adjusted to have their rear vertical planar surfaces 714*a* substantially located in the same plane and slightly rearwardly of the transverse vertical plane of the rear edge of strip 81 while the rear terminal edges 711*a* of cups 711 are located slightly forwardly of said transverse plane. Additionally the bumpers of assembly 720 are longitudinally adjusted to have their generally planar front surfaces 735*a* substantially located in the same vertical plane, parallel to the planar surfaces 711*a* of bumpers 711 and slightly forwardly of the transverse vertical plane of the front edge of strip 730 while the front terminal edges 732*a* of cups 732 are located slightly rearwardly of the last mentioned plane.

In using the third embodiment, the leading bag 500 is fed downwardly to its preselected position between the vacuum cups 711, 732 in their datum positions whereat the bag mouth edge 501 is at an elevation just above that of the top surfaces of the bumpers 714, 735 and at or slightly below the elevation of the separation plate apex 85*a*. Then the bag opening piston rods 69 in retracting move the angle iron 709 and the bumpers 714 to contact the adjacent side wall of the bag 500 to move the opposite side wall into abutting relationship with the bumpers 735 (FIG. 23 position) so that the bag is clampingly engaged by the bumpers. At this time, the central axes of the bumpers are in or nearly in direct longitudinal alignment with one another, the adjacent portions of each set of cooperating bumpers 714, 735 advantageously being circular cylindrical. The bumpers previously had been longitudinally adjusted relative the resilient strips 81, 730 so that after the bumpers are already under compression from clampingly engaging the bag, the strips 81, 730 move into abutting relationship with opposite side walls of the leading bag to clampingly engage the bag therebetween at a slightly lower elevation than the lowermost parts of the vacuum cups 711, 732. However, when the strips clampingly engage the bag and the rearward movement of bag opening assembly is stopped, there is still a slight clearance between rear terminal edges of cups 711 and the front terminal edges of cups 732 and the respective adjacent bag side wall to provide a space for air to rush into the bag mouth during the initial bag opening procedure.

With the leading bag 500 fed to its preselected position and the bag opening and bag separating assemblies 708, 720 in their datum positions, in the same manner and at the same time during a cycle of operation of the first embodiments, the controls operate the cylinders 70 to move the bag opening mounting member 709 from its datum position towards its retracted second position. The bumpers 714 in moving with member 709 move to abut against the adjacent bag side wall that is opposite the bag separating assembly which in turn moves the opposite side wall into abutting relationship to the bumpers 735 to clamp the leading bag therebetween and compress the bumpers 714, 735. As bumpers 714, 735 are compressed, strip 81 moves relative to strip 730 to clamp the bag 500 therebetween across its transverse width but movement of the bag opening assembly in a forward direction stops prior to the cup peripheral terminal edges that are adjacent the side walls are moved into engagement with the side walls.

At the time the bag opening assembly moves to its forwardmost position, it operates the controls to apply air under pressure to the bag separating cylinder 728 to extend its piston rod and move the mounting member (angle iron) 742 in a longitudinally forward direction (arrow 740) and transversely (arrow 741), in other words diagonally at a small angle to the direction of forward movement, to move the mounting member 742 from its datum position toward its second position shown in dotted lines in FIG. 20. This movement forces the bag opening assembly 708 to move in the direction of arrow 740 against the resistence of air under pressure in cylinders 70 with the upper portion of the leading bag being clamped between bumpers 714, 735 and resilient strips 81, 730. The forward movement of the bag opening and bag separating assemblies with the leading bag clamped therebetween relative the separation plate results in bag 500 being separated from the bag roll web along its perforations in the same manner as described with reference to the first embodiment other than for a small transverse movement of one bag side wall relative to the other.

At the time the bag separating assembly was in its datum position and the bag opening assembly was in its forwardmost position, each bumper of one assembly was directly longitudinally, vertically and transversely aligned with a bumper of the other assembly with the leading bag extending therebetween, as were the resilient strips. However, since the bag opening assembly moves only in a longitudinal direction and the bag separating assembly moves diagonally, as the assemblies move together, the bumpers and resilient strip of the separating assembly become progressively further transversely offset in the direction of arrow 741 relative the corresponding members of the bag opening assembly. Due to the resiliency in the bag and shifting of one bag side wall relative the other resulting from the above mentioned relative transverse movement, one or the other or both upper bag side wall portions become wrinkled which facilitates the separation (unblocking) of the side walls and movement of the side walls relative the vacuum cups to be grippingly engaged by the vacuum cups. The spacing of the cups from the bag side walls just prior to the bag separating assembly moving from its datum position is sufficiently small that with the resiliency of the bag and shifting of the bag side walls, when a vacuum is applied to the cups, the respective side wall part moves to be grippingly engaged by the adjacent vacuum cup.

After the separating assembly has moved from its datum position, a vacuum is applied to the vacuum cups 711,732 in the same manner as described with reference to the first embodiment. Thus there is a slight delay between the initial forward movement of the bag separating assembly and the application of vacuum to the cups and accordingly some transverse movement of the separating assembly relative to the opening assembly has taken place prior to the application of vacuum to the cups.

Figure 23:
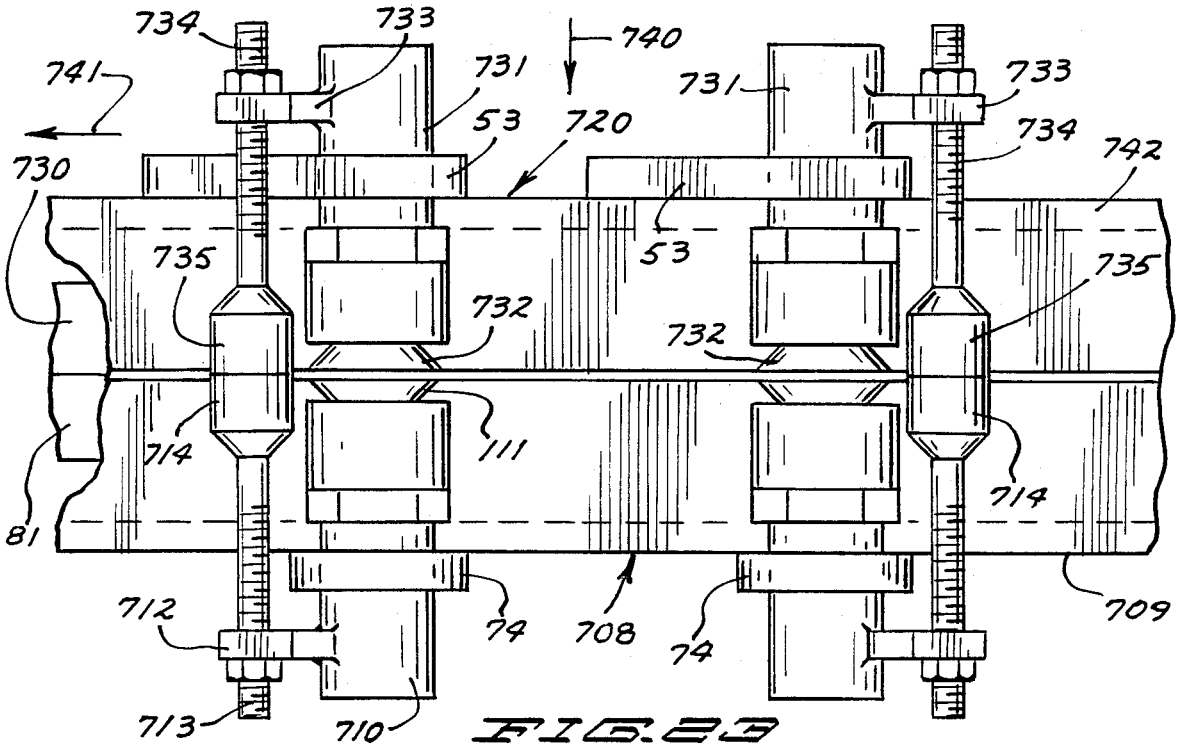
FIG. 23 is a fragmentary plan view generally taken along the line and in the direction of the arrows 23—23 of FIG. 21.
Figure 24:
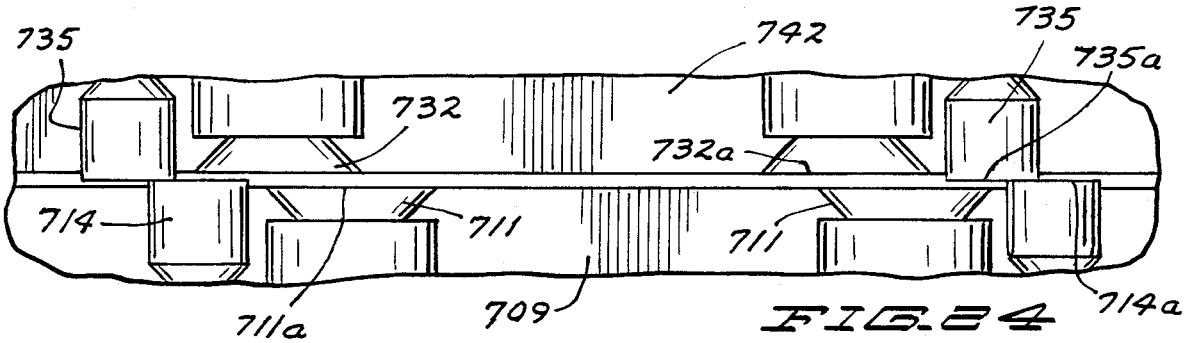
FIG. 24 is a view similar to FIG. 23 other than it shows the bag opening and bag separating assemblies in the bag opening assembly extended position and prior to the bag opening assembly moving away from the bag separating assembly to open the bag mouth.
Figure 21:
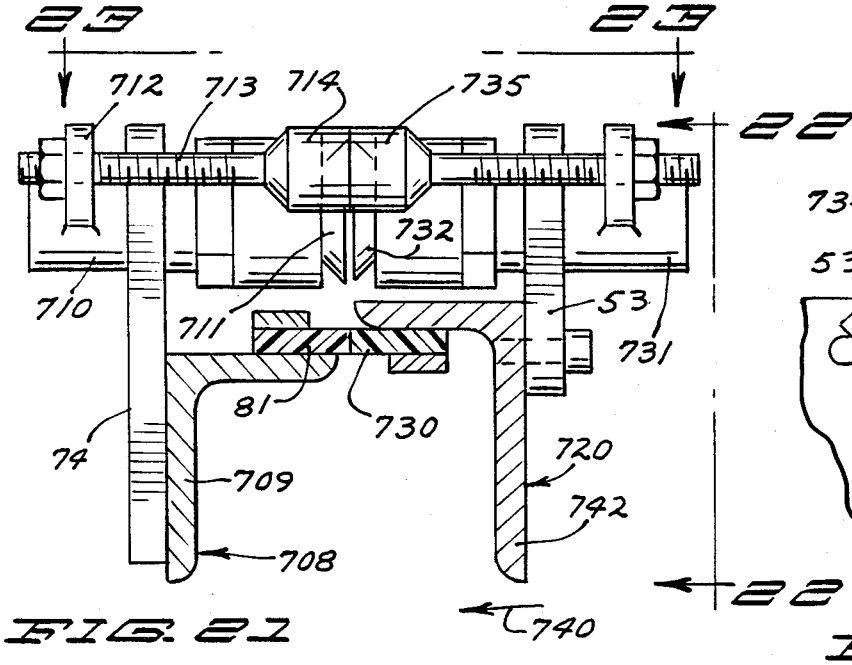
FIG. 21 is a fragmentary longitudinal cross sectional view generally taken along the line and in the direction of the arrows 21—21 of FIG. 20 of the bag separating assemblies in its datum position together with the bag opening assembly in its forward position to clampingly hold a bag therebetween.
Figure 22:
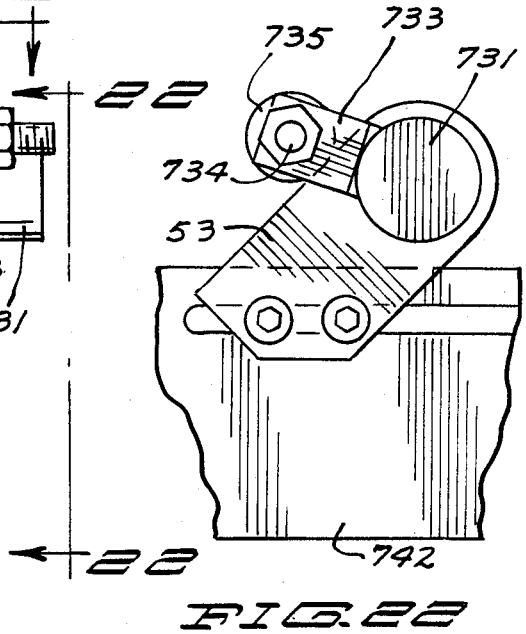
FIG. 22 is a view generally taken along the line and in the direction of the arrows 22—22 of FIG. 21 to show the structure for mounting one of the transversely intermediate bag opening vacuum cups and rubber bumpers.

When the bag separating assembly is at its extended dotted line position of FIG. 20, as shown in FIG. 24, the bumpers 734 are in part transversely offset from bumpers 714 and in part longitudinally aligned therewith, and still are at the same elevationals as they were in the FIG. 23 position. For example, with the diagonal movement of the bag opening assembly being about 7° relative longitudinal direction 740, the movement of angle iron 742 from its datum position to the dotted line extended position of FIG. 20 being about 4", and the diameters of the respective assembly longitudinally adjacent parts of the bumpers being $\frac{3}{4}$", there would still be about $\frac{1}{4}$" transverse overlap of the longitudinally adjacent parts of the bumpers. Thus the bumpers and strips still clampingly engage the leading bag therebetween when in the FIG. 24 positions.

When the bag separating assembly 720 is adjacent its extended position the controls are operated as described with reference to the first embodiment for applying air under pressure to cylinders 70 to move the bag opening assembly toward its datum position and when the separating assembly is in its extended position, moves the bag opening assembly away from (in direction of arrow 740) the bag opening assembly. However, before the opening assembly starts to move away from the separating assembly vacuum has been applied to the cups and the cups grippingly engage the opposite bag side walls. The slight spacing of the vacuum cup terminal edges from the leading bag prior to the bag opening and separating assemblies moving together from the separating assembly datum position provides for a space for air to rush into the bag when the bag mouth is opened through the opening assembly moving away from the separating assembly to its datum position.

The amount of transverse movement of one of the leading bag side walls relative the other is not sufficiently great to interfer with an inserter assembly aoving into the open mouth of a bag held by the opening assembly 708 in its datum position and the separating assembly in its extended position in the manner described with reference to the first embodiment or product moving from the hopper into the bag in the manner described with reference to the second embodiment.

It has been found with certain non gusseted web stock material that at times blocking occurred when attempting to open the bag mouth with the first embodiment. The third embodiment may be advantageously used with such stock material as well as others described with reference to the first embodiment.

It is believed that it is apparent from above the bag opening members 710–714 of the third embodiment may be mounted by bars 74 on the angle iron 62 of the first embodiment in place of vacuum cups 75; and that bag separating assembly 720 may be mounted on plate 51 of the first embodiment and used instead of the bag separating assembly 40 so as to move the angle iron thereof diagonally as described relative the third embodiment. With such a modification, the rollers 46, 47 would not be mounted on plates 45 but rather on plates 724 which would be mounted on plate 51 to extend at a small angle relative a longitudinal direction as would piston cylinder combination 728, 729. With the thus modified apparatus, in side view as seen in FIG. 3, angle irons 742, 62 would be movable longitudinally between the positions shown for angle irons 42, 62.

What is claimed is:

1. A bag inserter machine for separating a leading bag that is joined to a bag roll web of a bag roll along a perforated line and has opposite first and second side walls, a bag closure seal and a leading terminal edge remote from the perforated line and inserting the separated bag into an open case, the edge of the bag that was joined to the bag roll along the perforated line, after separation from the bag roll, defining the bag mouth, comprising a frame, first means on the frame for supporting the bag roll and feeding the leading bag joined to the bag roll to a preselected bag position, second means on the frame for engaging the bag in said preselected position, separating the bag from the bag roll along the preforated line and opening the bag mouth while supportingly holding the bag, the second means including separating means mounted on the frame for movement from a datum first position to a bag supporting, bag mouth open second position for engaging the bag first side wall adjacent the perforated line, bag opening means mounted on the frame for movement between a bag mouth open first position remote from the bag spearating means in its second position and a second position to abut against the bag second side wall when the bag separating means is in its first position and cooperate with the bag separating means to clampingly engage the bag while it is joined to the bag roll, said bag opening and bag separating means each including means for grippingly engaging the respective side wall of the bag remote from the bag closure and holding the bag in a bag mouth open condition when the bag separating and opening means are in their bag open positions, inserter means mounted on the frame for movement from a datum position to a position the bag that was being held in a bag mouth open condition is inserted into the case for moving the leading bag into the case, and control means for operating the first means to feed the bag joined to the bag roll to said bag preselected position, then the bag opening and bag separating means to clampingly engage the leading bag while it is joined to the bag roll and move the leading bag relative the feed means to separate the leading bag along the perforated line from the bag roll and after the leading bag is separated from the bag roll move the bag side walls to a bag mouth open condition, and thereafter the inserter means to insert the bag into the case.

2. The bag inserter machine of claim 1 further characterized in that the second means includes a separation plate on the frame for abutting against the bag roll web adjacent the perforated line as the bag opening and bag separating means clampingly engage the leading bag and the bag separating means moves toward its second position.

3. The bag inserter machine of claim 2 further characterized in that the feed means includes a pair of driven pinch rolls for clampingly holding the bag roll web on the opposite side of the perforated line from the leading bag with the leading bag in depending relationship thereto while the bag opening means moves toward its first position and the bag separating means moves toward its second position to separate the leading bag from the bag roll.

4. The bag inserter machine of claim 1 further characterized in that the bag opening and bag separating means include elongated resilient strips for cooperatively clampingly engaging the adjacent side wall.

5. The bag inserter machine of claim 4 further characterized in that the grippingly engaging means of each of the bag opening and bag separating means include vacuum means for grippingly engaging the adjacent side wall of the separated bag.

6. On a machine having a frame for separating a leading bag that is joined to a bag roll web along a perforated line and has opposite first and second side walls, a bag closure seal and a leading terminal edge remote from the perforated line, spearating the leading bag from the web after it has been fed to a preselected position, and opening the separated bag, the edge of the bag that was joined to the bag roll along the perforated line, after separation from the bag roll, defining the bag mouth, bag separating first means mounted on the frame for movement longitudinally and transversely from a rear datum first position adjacent the first side wall and on the opposite side of the bag from the second side wall to a forward second position that is on the opposite side of a bag in the bag preselected and bag opening second means mounted on the frame for longitudinal movement from a bag mouth open open first position remote from the bag separating means, and on the side of the bag preselected position opposite the bag separating means in its first position and a second position to abut against the bag second side wall and cooperate with the bag separating means to clampingly engage the leading bag adjacent the perforated line while it is joined to the bag roll, each of the bag opening means and the bag separating means including a transversely elongated mounting member, resilient third means for cooperating with the resilient third means of the other of the bag opening means and the bag separating means to clampingly engage the respective side wall of the leading bag adjacent its bag mouth edge, a plurality of vacuum cups for grippingly engaging the respective side wall adjacent the bag mouth edge, means for mounting the resilient third means and vacuum cups on the mounting member, and resilient fourth means mounted on the mounting member to clampingly engage the leading bag adjacent the vacuum cups on the side thereof opposite the bag mouth edge.

7. The apparatus of claim 6 further characterized in that second means includes means for translatorily longitudinally moving the second means mounting member between the second means positions and that the first means includes means for translatorily moving the first means mounting member diagonally at a small angle relative the direction of movement of the second means mounting member and supporting the last mentioned mounting member parallel to the second means mounting member.

8. The appartus of claim 7 further characterized in that said angle is about 3° to 7°.

9. The apparatus of claim 6 further characterized in that the resilient third means of each of the bag opening and separating means comprises a plurality of resilient bumpers having generally planar surfaces adjacent those of the other that are at least substantially located in the same plane for the respective one of the bag opening means and bag separating means and perpendicular to the direction of longitudinal movement of the bag opening means mounting member.

10. The apparatus of claim 9 further characterized in that each of the bumpers of the bag opening means is transversely and longitudinally aligned with a bumper of the bag separating means when the bag opening means is in each of its positions and the bag separating means is in its datum position, and are progressively more transversely offset as the bag separating means moves toward its second position.

11. The apparatus of claim 10 further characterized in that each of bag opening and separating means comprises a transversely elongated resilient strip having a transversely edge for abutting against the leading bag side wall and is located slightly more remote from the respective plane for the bag opening and bag separating means bumpers and on the longitudinal opposite side thereof from the plane for the other.

12. The apparatus of claim 10 further characterized in that the vacuum cups of each of the bag opening and bag separating means has a peripheral terminal edge for abutting against a bag side wall that is slightly further spaced from the said plane for the bumpers for the respective bag opening and bag separating means than the resilient strip transverse edge of the same one of the bag opening and bag separating means and on the same side thereof as the respective strip transverse edge.

13. A bag inserter machine for separating a leading bag that is joined to a bag roll along a perforated line and has opposite first and second side walls, a bag closure seal and a leading terminal edge remote from the perforated line and inserting the separated bag into an open case that has an open top perimetric edge and four side walls joined to form four corners, the edge of the bag that was joined to the bag roll along the perforated line, after separation from the bag roll, defining the bag mouth, comprising a frame, first means on the frame for supporting the bag roll and feeding the leading bag joined to the bag roll to a preselected bag position, second mens on the frame for engaging the bag in said preselected position, separating the bag from the bag roll along the perforated line and opening the bag mouth while supportingly holding the bag, the second means including separating means mounted on the frame for movement from a datum first position to a bag supporting, bag mouth open second position for engaging the bag first side wall adjacent the perforated line, bag opening means mounted on the frame for movement from a bag mouth open first position remote from the bag separating means in its second position to a second position to abut against the bag second side wall and cooperate with the bag separating means to clampingly engage the bag while it is joined the bag roll, said bag opening and bag separating means each including means for grippingly engaging the respective side wall of the bag remote from the bag closure and holding the bag in a bag mouth open condition when the bag separating and opening means are in their bag open positions, inserter means mounted on the frame for movement from a datum position to a position the bag that was being held in a bag mouth open condition is inserted into the case for moving the leading bag into the case, the inserter means including plunger means movable through the open bag mouth and into the bag to move the bag into the case and when in the bag inserter second position hold a part of the bag within the case and means for mechanically moving the bag to reversely bend it over the perimetric edge while the part of the bag is held within the case, the last mentioned means including a cuffing finger and means for moving the cuffing finger while extending within the bag to reversely bend the bag over the perimetric edge, the plunger means including a vertical piston rod having a central vertical axis and being movable between a retracted elevated position and an extended position, a plunger member for each case corner, extendable into the respective adjacent case corner and having a vertical extending portion generally parallel to said central axis and means for mounting the plunger members on the piston rod for movement therewith, the means for mechanically moving the bag including a cuffing finger for each plunger member, each cuffing finger having a lower terminal end and piston cylinder means mounted on each plunger member for moving the respective cuffing finger relative the plunger member between a retracted elevated position and an extended lower position that the cuffing finger lower terminal ends are located horizontally more remote from the central axis than in the cuffing finger retracted position, and control means for operating the first means to feed the bag joined to the bag roll to said bag preselected position, then the bag opening and bag supporting means to clampingly engage the leading bag and move the leading bag relative the feed means to separate the leading bag along the perforated line from the bag roll and move the bag side walls to a bag mouth open condition, and therafter the inserter means to insert the bag into the case.

14. For separating a leading bag that is joined to a flat folded bag roll tubular web of a bag roll along a perforated line and has opposite first and second side walls, a bag bottom closure seal and a leading terminal edge remote from the perforated line, the edge of the bag that was joined to the bag roll along the perforated line after separation from the bag roll web defining a bag mouth, opening the bag mouth and supportingly holding the separated bag adjacent its bag mouth above a case having an open top perimetric terminal edge that is to contain the leading bag, a bag separating and opening machine comprising a frame, first means on the frame for supporting the bag roll to rotate about a transverse axis, feeding the leading bag joined to the bag roll to a preselected bag position with the perforated line at a higher elevation than the leading bag terminal edge while the bag roll rotates about said axis and abuts against a web part on the side thereof opposite the perforated line to retain the abutted against web part stationary while the leading bag is being separated therefrom along the perforated line, and second means on the frame for engaging the leading bag in said bag preselected position, separating the leading bag from the web along said perforated line and opening the bag mouth while supportingly holding the leading bag side walls adjacent the bag mouth, the second means including bag separating means mounted on the frame for movement longitudinally from a rear datum first postion adjacent the first side wall and on the opposite side of the bag from the second side wall to a forward second position that is on the opposite side of a bag in the bag preselected position and bag opening means mounted on the frame for movement from a bag mouth open first position remote from the bag separating means and on the side of the bag preselected position opposite the bag separating means in its first position and a second position to abut against the bag second side wall and cooperate with the bag separating means to clampingly engage the leading bag adjacent the perforated line while it is joined to the bag roll, said bag opening and separating means including means for grippingly engaging the respective side wall of the bag adjacent the bag mouth, and control means for operating the first means to feed the leading bag while joined to the bag roll to said bag preselected position and the bag opening and separating means to clampingly engage the bag that has been fed to the bag preselected position, and while the web part is being retained stationary, pull the clampingly engaged bag to separate it from the bag web along said perforated line and the grippingly engaging means to move the opposite bag side walls to a bag mouth open condition when the bag opening means moved relative the bag separating means to its first position, the bag opening means and the bag separating means each including resilient third means for cooperating with the other of the bag opening and bag separating third means to clampingly engage the leading bag adjacent said perforated line while it is joined to the web and the bag separating means is in its datum position and the bag opening means is in its second position, and means for mounting the resilient means and the respective grippingly engaging means for movement therewith, the bag opening means including operable means for mounting the bag opening mounting means and moving it in a longitudinal direction generally perpendicular to the transverse width of the leading bag in said bag preselected position, and the bag separating means including operable means for mounting the bag separating mounting means and moving it in a direction at a small angle to the first mentioned direction, the bag opening and bag separating resilient means being longitudinally aligned with one another when the bag separating means is in its first position and the bag opening means is in its second position and at least partially transversely offset from one another when the bag separating means is in its second position.

15. The apparatus of claim 14 wherein the case has four side walls joined to form four corners, further characterized in that the plunger means includes a plunger member for each case corner, each plunger member having a vertically elongated portion located within the case interior adjacent the respective case corner when the inserter means is in its bag in the case inserted position, the plurality of cuffing fingers including a cuffing finger for each plunger member.

16. The apparatus of claim 15 further characterized in that the means for mounting and moving the fingers are mounted by the vertically elongated portions and move the fingers to have their terminal ends horizontally more remotely spaced from the vertical portions in the finger second position than the finger first positions.

17. For separating a leading bag that is joined to a flat folded bag roll tubular web of a bag roll along a perforated line and has opposite first and second side walls, a bag bottom closure seal and a leading terminal edge remote from the perforated line, the edge of the bag that was joined to the bag roll along the perforated line after separation from the bag roll web defining a bag mouth, opening the bag mouth and supportingly holding the separated bag adjacent its bag mouth above a case having an open top perimetric terminal edge that is to contain the leading bag, a bag separating and opening machine comprising a frame, first means on the frame for supporting the bag roll to rotate about a transverse axis, feeding the leading bag joined to the bag roll to a preselected bag position with the perforated line at a higher elevation than the leading bag terminal edge while the bag roll rotates about said axis and abuts against a web part on the side thereof opposite the perforated line to retain the abutted against web part stationary while the leading bag is being separated therefrom along the perforated line, and second means on the frame for engaging the leading bag in said bag preselected position, separating the leading bag from the web along said perforated line and opening the bag mouth while supportingly holding the leading bag side walls adjacent the bag mouth, the second means including bag separating means mounted on the frame for movement longitudinally from a rear datum first position adjacent the first side wall and on the opposite side of the bag from the second side wall to a forward bag mouth open second position that is on the opposite side of a bag in the bag preselected position and bag opening means mounted on the frame for movement from a bag mouth open first position remote from the bag separating means and on the side of the bag preselected position opposite the bag separating means in its first position and a second position to abut against the bag second side wall and cooperate with the bag separating means to clampingly engage the leading bag adjacent the perforated line while it is joined to the bag roll, said bag opening and separating means including means for grippingly engaging the respective side wall of the bag adjacent the bag mouth, and control means for operating the first means to feed the leading bag while joined to the bag roll to said bag preselected position and the bag opening and separating means to clampingly engage the bag that has been fed to the bag preselected position, and while the web part is being retained stationary, pull the clampingly engaged bag to separate it from the bag web along said perforated line and the grippingly engaging means to move the opposite bag side walls to a bag mouth open condition when the bag opening means moved relative the bag separating means to its first position.

18. The apparatus of claim 17 further characterized in that the bag opening and separating means each includes resilient third means for cooperating with the other to clampingly engage the leading bag adjacent said perforated line while it is joined to the web and the bag separating means is in its datum position and the bag opening means is in its second position, and means for mounting the resilient means and the respective grippingly engaging means for movement therewith, that the bag opening means includes operable means for mounting the bag opening mounting means and moving it in a longitudinal direction generally perpendicular to the transverse width of the leading bag in said bag presected position, and that the bag separting means includes operable means for mounting the bag separating mounting means and moving it in a direction at a small angle to the first mentioned direction, the bag opening and bag separating resilient means being longitudinally aligned with one another when the bag separating means is in its first position and the bag opening means is in its second position and at least partially transversely offset from one another when the bag separating means is in its second position.

19. The apparatus of claim 18 further characterized in that the bag opening and bag separating grippingly engaging means each includes a plurality of transversely spaced vacuum cups and that the third and fourth resilient means each includes a plurality of transversely spaced resilient members having uppermost parts that extend at least to about as high an elevation as the uppermost parts of the vacuum cups on the respective resilient means mounting means.

20. The apparatus of claim 19 further characterized in that the bag opening and bag separating means each includes a transversely elongated resilient strip mounted on the respective resilient means mounting means to cooperate with the other to clampingly engage the leading bag at an elevation below the vacuum cups on the same mounting means.

21. The apparatus of claim 20 further characterized in that the bag opening and bag separating members each have generally planar surfaces longitudinally adjacent those of the other that are substantially perpendicular to the direction of movement of the bag opening resilient means mounting means between its positions, the bag separating means resilient members surfaces being substantially located in a first transverse common plane and the bag opening means resilient members surfaces being substantially located in a second transverse common plane when the bag opening and bag separating means are in their first positions.

22. The apparatus of claim 21 further characterized that the resilient strips have longitudinally adjacent transverse edges, the bag separating means strip edge being closely adjacent the first common plane and the bag opening means strip edge being closely adjacent the second common plane.

23. The apparatus of claim 22 further characterized in that the vacuum cups have terminal peripheral edges, the bag separating means cups being slightly spaced from the first common plane and longitudinally on the opposite side thereof from the second common plane, and the bag opening means cups being slightly spaced from the second common plane and longitudinally on the opposite side thereof from the first common plane.

24. For separating a leading bag that is joined to a flat folded bag roll tubular web of a bag roll along a perforated line and has opposite first and second side walls, a bag bottom closure seal and a leading terminal edge remote from the perforated line, the edge of the bag that was joined to the bag roll along the perforated line after separation from the bag roll web defining a bag mouth, opening the bag mouth and supportingly holding the separated bag adjacent its bag mouth above a case having an open top perimetric terminal edge that is to contain the leading bag, a bag separating and opening machine comprising a frame, first means on the frame for supporting the bag roll to rotate about a transverse axis, feeding the leading bag joined to the bag roll to a preselected bag position with the perforated line at a higher elevation than the leading bag terminal edge while the bag roll rotates about said axis and abuts against a web part of the side thereof opposite the perforated line to retain the abutted against web part stationary while the leading bag is being separated therefrom along the perforated line, and second means on the frame for engaging the leading bag in said bag preselected position, separating the leading bag from the web along said perforated line and opening the bag mouth while supportingly holding the leading bag side walls adjacent the bag mouth, the second means including bag separating means mounted on the frame for movement longtitudinally from a rear datum first position adjacent the first side wall and on the opposite side of the bag from the second side wall to a forward second position that is on the opposite side of a bag in the bag preselected position and bag opening means mounted on the frame for movement from a bag mouth open first position remote from the bag separating means and on the side of the bag preselected position opposite the bag separating means in its first position and a second position to abut against the bag second side wall and cooperate with the bag separating means to clampingly engage the leading bag adjacent the perforated line while it is joined to the bag roll, said bag opening and separating means including means for grippingly engaging the respective side wall of the bag adjacent the bag mouth, and control means for operating the first means to feed the leading bag while joined to the bag roll to said bag preselected position and the bag opening and separating means to clampingly engage the bag that has been fed to the bag preselected position, and while the web part is being retained stationary, pull the clampingly engaged bag to separate it from the bag web along said perforated line and the grippingly engaging means to move the opposite bag side walls to a bag mouth open condition when the bag opening means moved relative the bag separating means to its first position, the bag opening means and the bag separating means each including a transversely elongated resilient strip to cooperate with the resilient strip of the other of the bag opening means and the bag separating means resilient strip to clampingly engage the leading bag along the major portion of the transverse width of the leading bag while it is joined to the web and being pulled to separate the leading bag from the web.

25. The apparatus of claim 24 further characterized in that there is provided a separation plate that is mounted on the frame to abut against the web adjacent the perforated line as the bag is pulled by the bag opening and bag separating means to separate the leading bag from the web to facilitate the separation of the leading bag from the web along the perforated line.

26. The apparatus of claim 24 further characterized in that the control means includes means to operate the bag opening means from its first position to its second position while the bag separating means is in its datum position and the leading bag is in its preselected position to move the resilient strips relative one another to clampingly engage the leading bag and thus move the bag separating means toward its second position to force the bag opening means toward its first position while the leading bag is clampingly engaged by the resilient strips.

27. The apparatus of claim 26 further characterized in the control means includes means to operate the bag opening means away from the bag separating means and toward its first position after the bag opening means has been forced by the separating means to move therewith to separate the leading bag from the bag web and the gripping means to grippingly engage the leading bag after the bag has been moved to its preselected position and before the bag opening means is moved away from the bag separating means.

28. The apparatus of claim 27 further characterized in that each of the bag opening and bag separating means includes a transversely elongated mounting member that mounts the respective resilient strip and that the gripping means includes vacuum cup means mounted on each of the mounting members to cooperate with the vacuum cup means on the other member to gripping engage the adjacent leading bag side wall adjacent the resilient strip on the same mounting member.

29. The apparatus of claim 28 further characterized in that each of the bag opening and bag separating means includes guide means joined to the respective mounting member to mount the respective mounting member for translatory movement and operable piston cylinder means for reciprocating the respective mounting member between the respective bag opening and bag separating means positions.

30. The apparatus of claim 28 further characterized in that there is provided a hopper assembly having a discharge spout for discharging product into the bag grippingly engaged by the vacuum cup means when the bag opening assembly is in its first position and the bag separating assembly is in its second position.

31. The apparatus of claim 30 further characterized in that there is provided bag inserter means mounted on the frame for movement between a retracted elevated first position to an extended lowered second position extended into a case for moving into a bag grippingly engaged by the vacuum cup means when the bag opening assembly is in its first position and the bag separating assembly is on its second position and moving the bag in an open condition into the case.

32. The apparatus of claim 30 further characterized in that the inserter means includes means for cuffing the bag over the case terminal edge after the inserter means has moved to extend into the case.

33. The apparatus of claim 28 further characterized in that there is provided bag guide means for cooperating with the feed means to retain the leading bag in the preselected position until at least one of the bag opening means is moved from its first position toward its second position and the bag separating means is moved from its first position toward its second position.

34. The apparatus of claim 33 further characterized in that there is provided a transverse separation plate mounted on the frame to abut against the web adjacent the perforated line as the bag is pulled by the bag opening and bag separating means to separate the leading bag from the web, the separation plate having a lower transverse edge at a lower elevation than the abutted against web part that is retained stationary, a higher elevation than the resilient strips and vacuum cup means, and horizontal between the first and second positions of the bag separating means resilient strip and vacuum cup means.

35. The apparatus of claim 34 further characterized in that the bag guide means includes a transversely extending member mounted on the frame and has a top surface for having the bag side walls pulled thereover as the bag opening means grippingly engages the adjacent side wall and the bag opening means is moved towards its first position, the transverse member top surface being at a lower elevation than the vacuum cup means and resilient strips and horizontally between the separation plate and the bag opening means resilient strip and vacuum cups means in the bag opening means first position.

36. The apparatus of claim 35 further characterized in that the bag guide means includes a portion having an upper end joined to the transverse member and extends downwardly in a horizontal direction more remote from the bag opening means resilient strip and vacuum cup means when they are in their bag opening means first positions.

37. A bag inserter machine for separating a leading bag that is joined to a flat folded bag roll tubular web of a flat formed or gussetted bag roll along a perforated line and has opposite first and second side walls, a bag bottom closure seal and a leading terminal edge remote from the perforated line, the edge of the bag that was joined to the bag roll along the perforated line after separation from the bag roll web defining a bag mouth, and inserting the separated bag into a case having an open top perimetric terminal edge, a case interior and a case bottom, comprising a conveyer assembly for having a case moved thereover to a bag insert position, a frame, first means on the frame for supporting the bag roll to rotate about a transverse axis and feeding the leading bag joined to the bag roll to a preselected bag position with the perforated line at a higher elevation than the leading bag terminal edge while the bag roll rotates about said axis, said first means including pinch roll means for abutting against the web opposite the perforated line from the leading bag in the bag preselected position to hold the abutted against web part stationary while the leading bag is being separated from the web, second means on the frame for grippingly engaging the leading bag in said bag preselected position, separating the leading bag from the web along said perforated line, and opening the bag mouth while supportingly grippingly engaging the leading bag adjacent the bag mouth, bag inserter means mounted on the frame for movement from an elevated first position at a higher elevation than the case and the bag mouth of the supported opened bag, through a second position extending through the bag mouth and into the opened bag that is being supportingly held by the second means and a lowered bag in the case inserted third position extending within the case interior adjacent the case bottom when the case is in a bag insert position on the conveyer assembly, and bag guide means mounted on the frame for retaining the leading bag out of the path movement of a case on the conveyer assembly until the inserter means has moved into the opened bag and cooperating with the feed means to hold the leading bag in said preselected position at least until the leading bag in said preselected position is engaged by the bag opening and separating means, the bag guide means including a transversely extending member having a top surface abuttable against the leading bag second side wall at an elevation between the bag mouth and the bag terminal edge as the bag mouth is being opened, said top surface being at an elevation vertically between the terminal edge of a case in the bag insert position and the gripping engagement of the leading bag by the bag opening and separating means and horizontal between the case in a bag insert position on the conveyer assembly and the side wall of leading bag in said preselected position and a guide portion joined to said transverse member to extend downwardly from the transverse member in a direction away from a case in the bag insert position on the conveyer assembly.

38. The bag inserter machine of claim 37 further characterized in that the second means includes bag opening means mounted for movement from a first position for grippingly engaging the second side wall of the leading bag in the bag preselected position and a second position to open the bag mouth, the second side wall gripping engaging means being at a higher elevation than the terminal edge of the case in the bag insert position in both its first and second positions, in its first position horizontal on the opposite side of the transverse member top surface from a case in the bag insert position and in its second position horizontally between the transverse top surface and the case in the bag insert position and means mounted on the frame for mounting the second side wall gripping engaging means and moving it between its positions.

39. In a machine for inserting a bag having a bag bottom closure, opposite side walls and an upper edge defining an open bag mouth into an open case having a case bottom, an interior and a top perimetric terminal edge, a frame, means on the frame for releasably supporting a bag with an open bag mouth above the case top perimetric edge and inserter means mounted on the frame for movement from a retracted position above the open bag mouth, through a position extending through the bag mouth and into the bag and to an extended position abutting against the bag bottom to move the bag into the case interior with the bag upper edge above the top perimentric edge, said inserter means including bag top portion mechanical cuffing means extended into the bag in the bag inserted in the case position for moving the bag from a position wherein the bag top edge extends above the perimetric edge to a cuffed position the bag is reversely bent over the perimetric edge with the bag upper edge exterior of the case and at a lower elevation than the perimetric edge, plunger means extendable into the opened bag for moving the bag adjacent to the case bottom and means mounted on the frame for moving the plunger means from a retracted position above the open bag mouth to an extended position to move the bag bottom adjacent to the case bottom, said cuffing means means including a plurality of vertically elongated cuffing fingers having lower terminal ends that are spaced from one another in a horizontal plane, and means mounted on the plunger means for movement therewith for mounting the fingers and moving the fingers relative to the plunger means after the plunger means has been moved to its extended position from an elevated first position that the fingers terminal ends are within the bag that has been moved into the case by the plunger means and at a lower elevation than the bag upper edge and a lower elevation than the terminal edge, and a lowered second position that the finger terminal ends are horizontally more remotely spaced from one another than in their first position and are at a lower elevation than the upper and terminal edges exterior of the bag and case so that the bag is reversely bent over the perimetric edge, said plunger means extending between the finger terminal ends and to a lower elevation than the finger terminal ends when the finger terminal ends are in their second positions.

40. The apparatus of claim 39 further characterized in that the means for mounting and moving the fingers includes for each finger a piston cylinder combination that is mounted on the plunger means.

41. On a machine having a frame for separating a leading bag that is joined to a bag roll web along a perforated line and has opposite first and second side walls, a bag closure seal and a leading terminal edge remote from the perforated line, separating the leading bag from the web after it has been fed to a preselected position, and opening the separated bag, the edge of the bag that was joined to the bag roll along the perforated line, after separation from the bag roll, defining the bag mouth, bag separating first means mounted on the frame for movement longitudinally and transversely from a rear datum first position adjacent the first side wall and on the opposite side of the bag from the second side wall to a forward bag mouth open second position that is on the opposite side of a bag in the bag preselected position and bag opening second means mounted on the frame for longitudinal movement from a bag mouth open first position remote from the bag separating means, and on the side of the bag preselected position opposite the bag separating means in its first position and a second position to abut against the bag second side wall and cooperate with the bag separating means to clampingly engage the leading bag adjacent the perforated line while it is joined to the bag roll, said first means including a first transversely elongated mounting member, a plurality of first vacuum cups mounted on the first mounting member for movement therewith to grippingly engage the first side wall, and resilient third means mounted on the first mounting member for movement therewith to abut against the first side wall vertically between the first vacuum cups and the bag mouth edge and the second mean including a second transversely elongated second mounting member, second vacuum cups mounted on the second mounting member for movement therewith to grippingly engage the second side wall, resilient fourth means mounted on the second mounting member for movement therewith to abut against the second side wall vertically between the second vacuum cups and the bag mouth edge and cooperate with the third means to clampingly engage the bag, the second means including fifth means for translatorily longitudinally moving the second means mounting member between the second means positions, the first means including sixth means for translatorily moving the first means mounting member diagonally at a small angle relative the direction of movement of the second means mounting member and supporting the last mentioned mounting member parallel to the second means mounting member, the sixth means moving the first means mounting member between the first means positions, and control mean for operating the fifth and sixth means to initially move the respective mounting member toward the first means second position, second means first position while the third and fourth means clampingly engage the bag.

42. The apparatus of claim 41 further characterized in that the control means includes means for applying a vacuum to the vacuum cups after the fifth and sixth means have started to move the respective mounting member toward the first means second position, second means first position and while the third and fourth means clampingly engage the bag, and after the vacuum cups have gripping engaged the adjacent bag side wall operate the fifth and sixth means to move the respective mounting member so that the third and fourth means move out of clamping engagement with the bag and the vacuum cups move the bag side walls to a bag mouth open condition.

* * * * *

UNITED STATES PATENT AND TRADEMARK OFFICE

CERTIFICATE OF CORRECTION

PATENT NO. :4,522,012

DATED :June 11, 1985

INVENTOR(S) :Rodney C. Nelson

It is certified that error appears in the above-identified patent and that said Letters Patent are hereby corrected as shown below:

Column 26, line 64, change "aoving" to --moved--, and
Column 28, line 46, delete the first occurrence of --open--.

Signed and Sealed this

*Seventeenth* Day of *December 1985*

[SEAL]

*Attest:*

DONALD J. QUIGG

*Attesting Officer*

*Commissioner of Patents and Trademarks*